US012618261B2

(12) United States Patent
Erdman et al.

(10) Patent No.: US 12,618,261 B2
(45) Date of Patent: May 5, 2026

(54) PRIVACY PANEL AND SYSTEM

(71) Applicant: MULTY HOME LP, Concord (CA)

(72) Inventors: Derek Erdman, Toronto (CA); Stevenson Tom, Markham (CA); Stephen Dixon, Oakville (CA)

(73) Assignee: MULTY HOME LP, Concord (CA)

( * ) Notice: Subject to any disclaimer, the term of this patent is extended or adjusted under 35 U.S.C. 154(b) by 214 days.

(21) Appl. No.: 17/634,334

(22) PCT Filed: Aug. 10, 2020

(86) PCT No.: PCT/CA2020/051097
§ 371 (c)(1),
(2) Date: Feb. 10, 2022

(87) PCT Pub. No.: WO2021/026646
PCT Pub. Date: Feb. 18, 2021

(65) Prior Publication Data
US 2022/0282521 A1 Sep. 8, 2022

Related U.S. Application Data

(60) Provisional application No. 62/885,245, filed on Aug. 10, 2019.

(51) Int. Cl.
*E04H 17/16* (2006.01)

(52) U.S. Cl.
CPC ..... *E04H 17/166* (2013.01); *E04H 17/1602* (2021.01); *E04H 17/17* (2021.01)

(58) Field of Classification Search
CPC .... E04H 17/1602; E04H 17/166; E04H 17/17
See application file for complete search history.

(56) References Cited

U.S. PATENT DOCUMENTS 2,482,339 A 9/1949 Hibbard et al.
2,898,258 A 8/1959 Meier et al.
3,801,072 A * 4/1974 Newberry, Jr. ..... E04H 17/1602 256/19
4,676,035 A * 6/1987 GangaRao ..... E04B 1/04 52/125.5

(Continued)

FOREIGN PATENT DOCUMENTS

DE 20 2011 004223 U1 6/2011
EP 273515 A * 7/1988 ..... B29C 65/42

(Continued)

OTHER PUBLICATIONS

Extended European Search Report, EP 20853313.3, dated Jul. 14, 2023 (9 p.).

(Continued)

*Primary Examiner* — Matthew R Mcmahon
(74) *Attorney, Agent, or Firm* — Eversheds Sutherland (US) LLP

(57) ABSTRACT

An engineered privacy panel comprising a recycled rubber composition, where the panel comprises one or more integral reinforcement members for reinforcement and providing fastening means for fastening the back of the panel to a support. The privacy panel can be used to make partitions and partition systems, each of which can be provided as a kit.

18 Claims, 25 Drawing Sheets

(56) References Cited

U.S. PATENT DOCUMENTS 4,727,701 A * 3/1988 Figari ..... E04B 5/263 52/483.1
4,961,298 A 10/1990 Nogradi
5,138,813 A * 8/1992 Cooney ..... E04C 2/382 52/704
5,184,808 A * 2/1993 Vesper ..... E04H 17/168 256/73
5,324,146 A * 6/1994 Parenti ..... F16B 43/00 244/158.1
5,492,307 A * 2/1996 Begue, Jr. ..... E04H 17/1404 256/66
5,660,907 A * 8/1997 Skalka ..... B29C 70/26 52/630
5,704,178 A 1/1998 Ciao
5,893,248 A * 4/1999 Beliveau ..... E04F 13/0803 52/309.7
6,470,639 B1 10/2002 Horn et al.
8,640,399 B2 * 2/2014 Fradera Pellicer ..... B28B 23/0062 52/125.4
9,109,615 B2 * 8/2015 Cuddy ..... F16B 5/01
9,512,621 B1 * 12/2016 Trezza ..... E04F 13/0875
10,309,098 B2 * 6/2019 Chadwell ..... E04C 2/365
11,199,019 B1 * 12/2021 Ramadan ..... B28B 23/0056
11,795,310 B2 * 10/2023 Erdman ..... B29B 7/7495
2006/0081827 A1 * 4/2006 Strong ..... E04H 17/1602 256/24
2009/0044461 A1 * 2/2009 Diamond ..... E04B 1/12 52/79.9
2012/0102861 A1 * 5/2012 Diamond ..... E04B 1/12 52/309.1
2018/0002107 A1 * 1/2018 Fingerhut ..... E04C 2/22

FOREIGN PATENT DOCUMENTS

GB 2478907 A 9/2011
WO 2007/084833 A2 7/2007
WO 2018094527 A1 5/2018

OTHER PUBLICATIONS

Notification Concerning Transmittal of International Preliminary Report on Patentability for PCT/CA1010/051097, dated Feb. 24, 2022 (1 p.).
International Preliminary Report on Patentability, dated Feb. 8, 2022 (6 pp.).
International Search Report and Written Opinion, PCT/CA2020/051097, dated Oct. 20, 2020 (9 pp.).

* cited by examiner

Introducing

DISTINCT Privacy Panel System

Living space transformation made easy – for ANY space.

POST SYSTEM FOUNDATION

DECORATIVE PANEL

| Attribute | DISTINCT Panel | Competition |
|---|---|---|
| **Ultimate panel install flexibility** | ✓ Engineered Panel designed to be installed on ANY surface DISTINCT Posts, wood posts, etc | ✗ Requires proprietary post system Must find your own mounting hardware |
| **Straight or 90 degree panel wall build** | ✓ Post system can be built in straight or 90 degree configurations | ✗ Only can be built in single straight configuration |
| **Use of multiple materials** | ✓ System accommodates any combination of Panel or Wood | ✗ Post system can only accommodate proprietary panels |
| **Multiple Surface Install or Standalone** | ✓ Deck surface install base Sonotube / Ground Stake Standalone floor stands | ✗ Single post base solution |
| **Easy installation** | ✓ Integrated threaded inserts, no predrilling | ✗ Must predrill mounting holes for mounting |
| **Superior Panel Build** | ✓ Steel reinforced provides unparalleled rigidity & strength | ✗ No internal rigidity or strength |
| **Superior Panel Design** | ✓ Stunning 3D Panel Designs | ✗ Simple "Flat" pattern Designs |
| **Superior Material** | ✓ Tough & Durable Recycled Rubber Material | ✗ PVC or other mixed materials |
| **Hardware included** | ✓ All mounting hardware Included (Bracket, Screws and washers) | ✗ No mounting hardware included |

FIG.14 (continued)

PRIVACY PANEL AND SYSTEM

FIELD

Described embodiments generally relate to engineered privacy panels, a partition including one or more of the engineered privacy panels and a partition system that may include a plurality of interconnected partitions that comprise one or more of the engineered privacy panels forming a variety of configurations and arrangements. The engineered privacy panels comprise recycled rubber materials and are esthetically pleasing.

BACKGROUND

Outdoor living is desirable in the cities, however, with the increased density of living units, privacy is at a premium. With adjoining dwellings, adjacent balconies and smaller yards, it may be desired to prevent others from seeing into one's space. Typically this includes desiring privacy around decks, patios, pool and outdoor hot tubs.

It is also desired to conceal unattractive features such as an air conditioning unit, sheds, garden supplies, pool equipment, recycling bins, garbage bins and the like.

Outdoor panels are available that provide privacy and may increase the attractiveness of the landscape design, however, they may not be manufactured of sufficient size, are not adequately structurally stable, may lack durability, are difficult to assemble and mount, and cannot be arranged in a customized design. Furthermore, many are fabricated from materials that have imperfections, do not weather well, can discolor, crack, warp and be infested by rot or pests.

It would be desirable to provide a privacy panel and system with desirable physical and environmental properties that is easy to mount to new or existing posts, walls and the like in a variety of configurations.

The discussion of the background herein is included to explain the context of the inventions described herein. This is not to be taken as an admission that any of the material referred to was published, known, or part of the common general knowledge as of the priority date of any of the claims.

SUMMARY

In embodiments are provided engineered privacy panels, a partition including one or more of the engineered privacy panels and a partition system comprising a plurality of interconnected partitions comprising one or more of the engineered privacy panels that can be formed into a variety of configurations and arrangements. The engineered privacy panels comprise recycled rubber compositions. The fastening means are discreetly formed (i.e. substantially concealed) and positioned such that the esthetics of the panel are maintained while supporting the panel firmly in place. As concealed, the fastening means are still readily fastened and unfastened as may be required.

In further embodiments are methods to make the engineered privacy panels, partitions incorporating the engineered privacy panels and a partition system comprising two or more partitions incorporating the engineered privacy panels. Partitions and partition systems can be freestanding or secured to a ground surface.

The engineered privacy panels of the invention in aspects and in embodiments is versatile to use and can be readily and easily reversibly affixed to a variety of supports in different spatial arrangements with minimal tools. As used forming part or all of a partition, the engineered privacy panels are easily secured to supports, easily removable from the supports (readily dismantled) and readily interchangeable.

The engineered privacy panels may serve many functions and are suitable for residential and commercial use. The privacy panels are decorative and may be used to enhance the esthetics of any spaces (indoor and outdoor) such as being used as wall art or as a façade to an existing structure. The privacy panels may also be used alone or as part of a partition or partition system to increase privacy in a variety of outdoor spaces as their three dimensional (3D) design limits visibility through the panel yet still permits some airflow (airflow allowance and wind resistance) and light there-through (sunlight mitigation). The panels used alone or in embodiments as part of a partition or partition system may be used to enclose and define an outdoor space such as for example around pool areas, patios, seating arrangements and hot tubs. They may also be used to conceal unattractive features such as an air conditioning unit, a shed, garden supplies, pool equipment, pumps, recycling bins, garbage bins and the like. They may also be used to shield against the sun (provide some shade) and wind. They may also be used to hang a vertical garden, hang other decorative elements, hang lights such as solar powered lights, or woven with a string of lights (solar powered or connected electrically) throughout the three dimensional patterns of the panel. Thus any type of outdoor accessory may be used and incorporated for use with the engineered privacy panels, partitions and partition systems of the invention. One of skill in the art will recognize that the engineered privacy panels may be used in any desired manner and is not limited.

The engineered privacy panels may be incorporated into an existing fence or fence system to replace portions of the fence or simply to change and increase the esthetics of a fence.

The engineered privacy panels of the invention in aspects and embodiments may form part of a partition that is free standing or alternatively mounted in the ground where the ground material can be grass, dirt, concrete, wood, engineered wood and the like.

In embodiments are kits comprising the engineered privacy panels. Kits may include a variety of components such as post mounting brackets and/or wall mounting brackets, associated hardware (for example, screws and lock washers), posts, bases for posts, and optional instructions for use. Kits may be customized with certain accessories or combination of accessories. For example, a kit may comprise another material such as wood panels in order to design a partition with a combination esthetic. Another non-limiting example is as a garden kit where the engineered privacy panel is part of a hanging garden and thus includes components of a hanging garden. Another non-limiting example is a lighted engineered privacy panel that may include lights suitable for attaching or weaving through-out the 3D design of the engineered panel. In one aspect the lights may be solar powered.

The engineered privacy panels comprise several advantages, some non-limiting advantages alone or in any combinations are: durable; weather resistant (sun, wind and changing temperatures); UV resistant; mold resistant; can be fabricated in any variety of 3D designs, colours and sizes; have limited visibility through the 3D design for privacy and may reduce wind and/or light there-through; pest resistant; strong and rigid; structurally stable to prevent warping; simple to fasten to vertical support in a reversible manner without damaging esthetics of the engineered privacy panel; multiple concealed fastening points that allows fastening to a vertical support in more than one spatial arrangement without detracting from esthetics of 3D design and to provide for a more secure fastening; easily to unfasten from support without damaging esthetics of 3D design.

In embodiments, the privacy panels are engineered (molded with a deliberate structure) from a recycled rubber composition. They are of a substantially unitary body. The recycled rubber composition comprises crumb rubber dispersed within a polyolefin matrix. In an aspect the crumb rubber is from recycled tires. In aspects the composition may further comprise ethylene propylene diene monomer (EPDM) as part of the crumb rubber. EPDM can be used to lower PAH emission to less than about 1.0 ppm PAH (such as benzo[a]pyrene, benzo[e]pyrene, benzo[a]anthracene, chrysen, benzo[b]fluoranthene, benzo[j]fluoranthene, benzo[k]fluoranthene, dibenzo[a,h]anthracene, indeno(1,2,3-cd) pyrene, acenaphthene, fluorene, acenophthylene, phenanthrene, pyrene, anthracene and fluranthene, naphthalene).

During the molding process of the panel, crumb rubber is mixed with granular polyolefin at temperatures such that the polyolefin melts and forms a matrix comprising dispersed crumb rubber. As fabricated by injection molding a recycled rubber composition, panels with three dimensional patterns are made that have a substantially even esthetic surface texture with respect to smoothness and reduced/decreased/minimal surface irregularities and a substantially even porosity.

The amount of crumb rubber to polyolefin used in the method can range from about 20%:80% by weight to 80%:20% by weight. In aspects the recycled rubber composition comprises about 25%, 30%, 35%, 40%, 45%, 50% to 80% crumb rubber and up to about 80% by weight polyolefin. In non-limiting aspects about 25% by weight recycled rubbed and about 75% by weight polyolefin.

In aspects of the invention the crumb rubber is provided in a range of about 25%-80% by weight, or 50% to 80% by weight in said composition, and the balance being polyolefin.

In any aspect the crumb rubber is up to about 10, 20, 30, 40, 50, 60, 70 or 80 mesh. In any aspect of the invention the crumb rubber is up to about 20 mesh.

In any aspect of the invention the crumb rubber is recycled rubber. In any aspect the rubber is selected from the group consisting of styrene-butadiene rubber (SBR), ethylene propylene diene rubber (EPDM), ethylene propylene rubber (EPR), butadiene rubber (BR) and mixtures thereof. In any aspect the rubber SBR is from ground scrap/used tires.

In any aspect the EPDM provides reduced PAH emissions compared to SBR as from scrap/used tires. In aspects EPDM may be added to the crumb rubber to make the panels REACH (Registration, Evaluation, Authorisation and Restriction of Chemicals) compliant. This may decrease potential negative impacts on human health or the environment in the process of manufacturing panels of the invention.

In any aspect of the invention about 15% to 80% or 15% to about 40% polyolefin is provided in said composition. In any aspect of the invention about 50% by weight polyolefin is provided in said composition.

In any aspect of the invention the polyolefin may have a melt index ranging between about 5 g/10 minutes to about 50 g/10 minutes. In any aspect of the invention the polyolefin is selected from the group consisting of polyethylene, polypropylene, polybutene, polyisoprene, polypentene and mixtures thereof. In any aspect of the invention the polyolefin is polyethylene or polypropylene.

In any aspect of the invention the recycled rubber composition may further comprise up to about 10% by weight additives.

In any aspect of the invention the additives are selected from the group consisting of titanium dioxide, UV stabilizers, calcium carbonate, talc, flame retardants and combinations thereof.

In any aspect of the invention the recycled rubber composition further comprises up to about 10% by weight colorants.

Generally, the engineered privacy panel is molded as a one piece (e.g. unitary) solid panel body with any desired dimensions and any desired 3D design. Solid meaning that the panel body is not a hollow structure.

In aspects the engineered privacy panel is substantially a three dimensional shape with four sides defining a width, height and thickness. Each angle may be at substantially 90 degrees. The privacy panel may have a width greater than a height defining a rectangular shape (landscape orientation). In other aspects, the privacy panel may be in an orientation to have a height greater than the width (portrait orientation). In other aspects, the privacy panel may be substantially square in shape with a width similar to its height. For use with conventional fence posts and the like, the privacy panel may be up to about 48 inches wide, about 24 inches in height and up to about an inch (about 2.54 cm) in thickness at the frame portion. It is understood that the thickness of the privacy panel will range throughout the 3D design.

The privacy panel is engineered as a single molded reinforced body of solid construction of a recycled rubber composition. The panel has a generally rectangular configuration with a continuous perimeter frame enclosing/surrounding a "window" defining a 3D pattern. The 3D pattern has a similar appearance on either the front or back side of the window. The frame provides an attractive border to the window encompassed by the 3D pattern and functions as a structural support for the panel as well as a means for fastening the privacy panel in different spatial arrangements whereby in one arrangement both sides of the window defining a 3D pattern are exposed for viewing, or in another arrangement only one side of the window defining a 3D pattern is exposed for viewing and the other fastened flush against a vertical surface (e.g. a wall).

As a structural support the top and bottom members of the frame each comprise an integral (enclosed therein, overmolded therein) elongate reinforcement member. In one embodiment the reinforcement member extends substantially the entire width of the top and the bottom members of the frame. Thus each panel comprises two elongate reinforcement members that are substantially parallel to one another. Each of the elongate reinforcement members comprises substantially adjacent threaded inserts at each of their respective ends that are only accessible (thus visible) from the back of the frame and are for receiving a fastening device. In this manner the esthetics of the front of the panel are not affected. When fastening a panel to a vertical support such as a post, a fastening device is driven into each of the threaded inserts, through a suitable coupling mounted to the vertical support, such that it engages with the body of the elongate reinforcement member and forms a strong attachment. Discretely fastening each corner of the back of the panel to a vertical support results in the strong, rigid connection especially as each fastening device engages with the elongate reinforcement member.

In further embodiments, the reinforcement member may be an integral elongate reinforcement member positioned at each corner of the top and/or bottom member each of which extends from the corners of panel towards the center of the panel. In this embodiment, the reinforcement members are not continuous from one end to the other of the top and/or bottom member. The reinforcement members are sized at each corner to receive the fastening points. Reinforcement members can be provided at both top corners of the panel at substantially each end of the top member and optionally at one or both corners at each end of the bottom member. The integral reinforcement members function in the same fashion whether provided as one long continuous reinforcement member running along substantially the entire length of the top and/or bottom member of the panel, or whether provided as discrete bodies at each end of the top member and further each end of the bottom member of the panel. The long continuous reinforcement member is provided with two adjacent apertures sized to accommodate fastening means at each end of the reinforcement member, thus a total of four apertures. In the discreet sized reinforcement members, there are two substantially adjacent apertures sized to accommodate fastening means.

In further embodiments, the back of the frame of the panel further comprises a threaded inserts on each side member directly below and aligned with the threaded insert in the top member of the frame extending into the elongate reinforcement member as well as on each side member directly above and aligned with the threaded insert in the bottom member of the frame extending into the elongate reinforcement member. In this manner, a wall mounting means (for example a wall bracket) can be affixed top back corner of the frame by driving a fastening device into one of the threaded inserts in the elongate reinforcement member thus allowing for example a key hole mounting to secure the panel flush against an essentially flat vertical surface (for example a wall). Providing additional threaded inserts in locations on the side members permits for the privacy panel to be hung in different orientations (landscape and portrait).

In further embodiments, the top and bottom members of the panel can be fabricated to have substantially small apertures sized to accommodate an optional center connector. A center connector helps to secure two panels together in a partition. These may be used in areas of more extreme weather for example.

During molding of the privacy panel, the elongate reinforcement members (whether long continuous, or shorter) are positioned and held within the mold tool with selected tooling insert providing a selected 3D design. Therefore the elongate reinforcement members are over-molded with the heated and mixed crumb rubber and polyolefin molten composition during injection molding. This results in a one piece construction of the privacy panel with each of the elongate reinforcement members, positioned within the top and bottom of the frame, being over-coated (embedded therein) with a layer of the recycled rubber composition. This results in a thickness of up to about 12 mm or less of recycled rubber composition on the front, back and top of the elongate bar within the top and bottom of the frame, in aspects up to about 10 mm, in further aspects up to about 9.5 mm. The composition extends from the bottom of the embedded bar and is integral into the window 3D pattern. The threaded inserts are pre-inserted before molding and sealed off during the injection molding process. Thus the reinforcement panels are not visible in the finished engineered privacy panel.

The reinforcement members are metallic and can be made of any type of metal. In one aspect, the metal is steel. Alloys of steel can also be used. The elongate reinforcement member is configured as a long straight metal bar sized as appropriate depending on the size of the panel being made. The elongate reinforcement member is of a length to extend substantially the entire horizontal width of the panel. The width may vary and should be sufficient to accommodate an aperture conventionally sized to receive a conventionally sized threaded insert. The thickness of the elongate reinforcement member may also vary and may be up to about 15 mm (0.59 inches), up to about 12 mm (0.42 inches), up to about 10 mm (0.39 inches), up to about 8 mm (0.31 inches), up to about 6 mm (0.24 inches) or up to about 4 mm (0.16 inches). One of skill in the art would understand how to select an appropriate length and width of steel bar for use as reinforcement members in the top and bottom of the frame of the panel. It is also understood that the steel bar may be configured such that the edges of the length of the metal bar are not completely flat but may be angled towards the back of the panel. As discreetly sized, the reinforcement member is not continuous through the entire length of the panel, but instead sized to accommodate the apertures and be positioned at a corner of the panel. One of skill in the art would understand that this non-continuous reinforcement member can be of varying lengths less than half of the length of the panel. The thickness may vary and be similar/the same as the elongate reinforcement member as discussed above.

In aspects, the elongate reinforcement member has two substantially adjacent apertures located at each end of the member configured with a threaded insert (threaded bushing) forming a concealed fastening means in the panel. This configuration is suitable for use with L shaped brackets that have apertures that can be lined up with the threaded inserts before fasteners are driven through both to secure the panel via the bracket to a vertical support. This configuration is also suitable for use with wall mount brackets.

According to an aspect of the invention is a reinforced privacy panel comprising a recycled rubber composition.

According to an aspect of the invention is a reinforced privacy panel comprising a recycled rubber composition, the panel comprising elongated reinforcement members comprising concealed fastening means for reversibly fastening the panel to a vertical support in different spatial arrangements.

According to an aspect of the invention is a unitary reinforced privacy panel comprising a recycled rubber composition, the panel comprising two integral elongated reinforcement members comprising concealed fastening means at each end of each of the reinforcement members for reversibly fastening a back side of the panel to a vertical support in different spatial arrangements.

According to an aspect of the invention is a molded privacy panel of a recycled rubber composition, the panel comprising a frame supporting therein two elongated reinforcement members comprising fastening means for reversibly fastening a back side of the panel to a vertical support in different spatial arrangements.

According to an aspect of the invention is a privacy panel of a recycled rubber composition, said privacy panel comprising:

- a unitary molded body defined by a rectangular frame having a top member and a bottom member connected at each respective end via side members, said frame enclosing and integral with a three dimensional pattern;
- a first elongate reinforcement member positioned within and spanning substantially the width of the top member and a second elongate reinforcement member positioned within and spanning substantially the width of the bottom member, wherein each of said first and second elongate reinforcement members comprise substantially adjacent threaded inserts at each of their respective ends, each of said threaded inserts are configured to receive a fastening means for fastening the back side of the panel to a vertical support.

In aspects the three dimensional pattern is the same on the front and on the back of the panel.

In any aspects, the three dimensional pattern may vary in thickness throughout the pattern or in portions of the pattern.

In any aspects, the three dimensional pattern allows for a partially obstructed view there-through.

According to an aspect of the invention is a one piece molded privacy panel of a recycled rubber composition, said privacy panel comprising:

a substantially rectangular continuous frame having a top member, a bottom member and side members, said frame defining a window enclosing and integral with a three dimensional pattern;

a first elongate reinforcement member positioned within and spanning substantially the width of the top member of the frame, said first member comprising two adjacent threaded inserts at each end;

a second elongate reinforcement member positioned within and spanning substantially the width of the bottom member of the frame, said second member comprising two adjacent threaded inserts at each end;

the side members comprising a threaded aperture positioned substantially below and substantially above one of the threaded apertures of the first and second elongate reinforcement members;

wherein each of the threaded inserts of said first and second elongate reinforcement members are configured to receive a fastening means for fastening the panel from the back side to a vertical support.

In aspects the privacy panel is an injection molded reinforced privacy panel made from a crumb rubber and polyolefin composition, wherein the panel comprises a peripheral continuous frame enclosing and integrally formed with a window of a three dimensional decorative design that provides a partially obstructed view. The three dimensional designs incorporate passages/spaces allowing some vision, light and airflow through the panel. The privacy panel is reinforced with the provision of elongate metal bar that is embedded within (during the process of injection molding the panel, the elongate metal bar is insert molded into the panel such that it is over-coated and embedded within the rubber crumb and polyolefin composition) and extends through substantially the width of the top member and the width of the bottom member of the frame.

According to an aspect, is a molded crumb rubber and polyolefin privacy panel that comprises an elongate reinforcement member positioned within a top and within a bottom perimeter of the panel, each member extending substantially the entire width of the panel and each comprising concealed fastening means at each end of each elongate reinforcement member to receive a fastening device solely through the back of the panel to fasten the panel to a support structure via an intermediate structure such as a bracket.

According to a further aspect, is an injection molded privacy panel of a crumb rubber and polyolefin composition, wherein the panel comprises a peripheral frame that encloses a three dimensional design providing a partially obstructed view, wherein the top and bottom of the frame portion has an integrally formed reinforcement member spanning substantially along the complete width of the top and the bottom of the frame, wherein top and bottom corners of the back of the frame comprise concealed fastening means for receiving a fastener that engages with threaded inserts of the reinforcement members for fastening the back of the panel to a bracket for fixing to a post or a vertical wall.

According to a further aspect, is an injection molded privacy panel of a crumb rubber and polyolefin composition, wherein the panel comprises;

a frame that encloses a three dimensional design;

integral reinforcement members each spanning substantially the entire width of the top and the bottom of the frame; and the reinforcement members comprising concealed fastening means disposed in the back corners of frame for receiving a fastening device to fasten the back of the privacy panel at each corner to a support structure.

In aspects, the fastening means are threaded holes for receiving a fastening device.

In aspects, the fastening means are located at the back of the frame at fastening points located at each of the top and bottom corners of the back of the frame and do not extend to the front of the frame or penetrate the front of the frame.

In aspects, the fastening means comprises one threaded insert in each end of each of the reinforcement members and one threaded insert directly below or directly above and aligned with the threaded insert of the reinforcement members on each side of the outer frame.

According to an aspect, is a partition comprising one or more engineered privacy panels as described herein.

According to an aspect, is a partition comprising up to three engineered privacy panels as described herein, wherein at least one of the panels has a design that is different to a design of the other panels.

According to an aspect, is a partition comprising one or more engineered privacy panels as described herein and wood panels.

According to an aspect, is a partition comprising one or more engineered privacy panels as described herein fastened to respective support structures to support the one or more engineered privacy panels in a vertical orientation.

According to an aspect, is a privacy partition comprising one or more privacy panels engineered from a crumb rubber/polyolefin composition vertically mounted to a post support.

According to an aspect, are two adjoined privacy partitions comprising one or more privacy panels as described herein. In aspects the partitions are adjoined in a side by side relationship or angled, such as at a 90 degree angle.

According to an aspect, are three adjoined privacy partitions comprising one or more privacy panels as described herein. In aspects the partitions adjoined side by side or angled, such as at a 90 degree angle. In aspects two of the adjoined privacy panels are at 90 degree angles forming an enclosure.

In any aspect, adjacent panels within a partition or between two or more interconnected partitions have a substantially identical configuration and/or pattern.

In any aspect, adjacent panels within a partition or between two or more interconnected partitions have a substantially different configuration and/or pattern.

In any aspect, adjacent panels within a partition or between two or more interconnected partitions have a substantially different length and/or pattern. In such aspects, the length of each privacy panel of a partition can vary.

In any aspect, partitions comprising a privacy panel as described herein can be free standing, mounted to a ground structure (grass, dirt, concrete, tile, wood and the like) or mounted to a vertical structure.

According to an aspect is a partition system comprising one or more interconnected partitions comprising one or more privacy panels as described herein.

In any aspect of the invention processing to form the panel comprises injection molding a crumb rubber and polyolefin molten composition at elevated temperatures/heat of from about 140° C. to about 230° C., in aspects about 180° C., into a cavity of a closed injection mold tool having tooling inserts to form a selected decorative three dimensional design and two steel reinforcement bars having sealed off threaded inserts and placed into pre-determined static locations of the injection mold. Once mold is filled with the composition, cured and solidified, the mold tool is opened and the panel ejected/removed. Each of the steel reinforcement bars are as such insert molded into the panel at specific locations and embedded within the polyolefin matrix with the unobstructed threaded inserts ready to receive a fastening device from only the back of the panel and thus concealed such that the esthetic look of the front of the panel is not affected.

In aspects the privacy panel has some pliability.

In aspects the privacy panel is substantially water resistant.

In aspects the privacy panel has a substantially even surface texture.

In aspects the privacy panel is minimally porous, or rather has decreased porosity compared to conventional rubber articles.

In aspects, the privacy panel has less than 1.0 ppm PAH. The engineered privacy panels are in aspects environmentally friendly.

In aspects, the privacy panel has a substantially smooth surface substantially devoid of rubber particles projecting through to the surface.

According to a further aspect is a method of making a privacy panel as disclosed herein comprising;

providing a mold that defines the shape and pattern of the panel;

fixedly positioning two elongated reinforcement members in the mold; and injecting a molten mixture of crumb rubber within a polyolefin matrix into the mold to fill the mold and surround and encapsulate the reinforcement members;

allowing the mixture to cure and solidify; and remove the formed panel from the mold.

In aspects, the reinforcement members comprise threaded inserts at each of their respective ends that are plugged prior to the injection of the molten mixture.

Non-limiting aspects comprise:

1. A panel comprising a reinforced body, wherein the reinforced body comprises one or more integral reinforcement members each comprising means for fastening the panel to a vertical support.

2. The panel of aspect 1, comprising two integral reinforcement members.

3. The panel of aspect 1, comprising three integral reinforcement members.

4. The panel of aspect 1, comprising four integral reinforcement members.

5. The panel of any one of aspects 1 to 4, wherein each of the reinforcement members comprises two substantially adjacent apertures, each of said apertures fitted with a threaded insert.

6. The panel of any one of aspects 1 to 5, wherein the reinforced body comprises a frame with a top member and a bottom member connected by side members, wherein the top member and/or the bottom member comprises an elongate integral reinforcement member comprising the adjacent apertures fitted with threaded inserts at each of its ends.

7. The panel of any one of aspects 1 to 5, wherein the reinforced body comprises a frame with a top member and a bottom member connected by side members, wherein the top member comprises an elongate integral reinforcement member comprising the adjacent apertures fitted with threaded inserts at each of its ends and the bottom member comprises a discreet reinforcement member at each end with threaded inserts.

8. The panel of any one of aspects 1 to 5, wherein the reinforced body comprises a frame with a top member and a bottom member connected by side members, wherein the bottom member comprises an elongate integral reinforcement member comprising the adjacent apertures fitted with threaded inserts at each of its ends and the top member comprises a discreet reinforcement member at each end with threaded inserts.

9. The panel of any one of aspects 1 to 5, wherein the reinforced body comprises a frame with a top member and a bottom member connected by side members, wherein the top member comprises a discreet integral reinforcement member comprising the adjacent apertures fitted with threaded inserts at each of its ends and the bottom member comprises a discreet integral reinforcement member comprising the adjacent apertures fitted with threaded inserts at each of its ends.

10. The panel of any one of aspects 1 to 4, wherein the reinforced body comprises a frame with a top member and a bottom member connected by side members, wherein the threaded inserts form the reinforcement members.

10a. The panel of any one of aspects 6 to 10, wherein the side members comprise a top threaded insert and a bottom threaded insert at each end for mounting a wall bracket.

11. The panel of any one of aspects 6 to 11, wherein the top member and/or the bottom member further comprise a substantially central connection member aperture.

12. The panel of any one of aspects 1 to 11, wherein the reinforcement members are made of metal.

13. The panel of aspect 12, wherein the metal is steel or a steel alloy.

14. The panel of any one of aspects 1 to 13, wherein the panel comprises a front face and a back face with a decorative pattern.

15. The panel of aspect 14, wherein the decorative pattern is three dimensional.

16. The panel of aspect 15, wherein the decorative pattern permits the flow of air and/or sunlight to pass through.

17. The panel of any one of aspects 14 to 16, wherein the decorative pattern comprises slats.

18. The panel of any one of aspects 14 to 16, wherein the decorative pattern comprises a knot or cross-weave design.

19. The panel of any one of aspects 1 to 18 formed from a recycled rubber composition.

20. The panel of aspect 19, wherein the recycled rubber composition comprises ground crumb SBR and optionally EPDM.

21. The panel of aspect 19 or 20, wherein the recycled rubber composition comprises polyolefin.

22. The panel of aspect 21, wherein the polyolefin is selected from the group consisting of polyethylene, polypropylene, polybutene, polyisoprene, polypentene and mixtures thereof.

23. The panel of aspect 22, wherein the polyolefin is polyethylene and/or polypropylene.

24. The panel of any one of aspects 19 to 23, wherein the ground crumb rubber to polyolefin is provided in a ratio of about 20:80 to 80:20 crumb rubber to polyolefin by weight.

25. The panel of any one of aspects 19 to 24, wherein the composition further comprises additives and/or colorants.

26. The panel of any one of aspects 1 to 25, further comprising a fastening device affixed to each of the integral reinforcement members on a back side of the panel, said fastening device further comprising means to fasten the panel to the vertical support.

27. A partition comprising one or more of the panels of any one of aspects 1 to 26 mounted in between two vertical supports.

28. A partition system comprising two or more partitions of aspect 27.

29. The partition of aspect 27, or the partition system of aspect 28 provided as a kit with instructions.

30. An engineered privacy panel comprising a recycled rubber composition, wherein said panel comprises one or more integral reinforcement members each comprising means for fastening the back of the panel to a vertical support and optionally one or more connection member apertures.

31. A privacy panel comprising a recycled rubber composition, said privacy panel comprising:

a unitary molded body defined by a rectangular frame having a top member and a bottom member connected at each respective end via side members, said frame enclosing and integral with a three dimensional pattern;

a first elongate reinforcement member positioned within and spanning substantially the width of the top member and a second elongate reinforcement member positioned within and spanning substantially the width of the bottom member, wherein each of said first and second elongate reinforcement members comprise substantially adjacent threaded inserts at each of their respective ends, each of said threaded inserts are configured to receive a fastening means for fastening the back side of the panel to a vertical support.

32. A one piece molded privacy panel of a recycled rubber composition, said privacy panel comprising:

a substantially rectangular continuous frame having a top member, a bottom member and side members, said frame defining a window enclosing and integral with a three dimensional pattern;

a first elongate reinforcement member positioned within and spanning substantially the width of the top member of the frame, said first member comprising two adjacent threaded inserts at each end;

a second elongate reinforcement member positioned within and spanning substantially the width of the bottom member of the frame, said second member comprising two adjacent threaded inserts at each end;

the side members comprising a threaded aperture positioned substantially below and substantially above one of the threaded apertures of the first and second elongate reinforcement members;

wherein each of the threaded inserts of said first and second elongate reinforcement members are configured to receive a fastening means for fastening the panel from the back side to a vertical support.

33. A partition comprising the panel of any one of aspects 30 to 32.

34. A plurality of interconnected partitions of aspect 33 or a plurality of interconnected panels of any one of aspects 1 to 26 and 30 to 32.

35. A kit comprising a panel of any one of aspects 1 to 26 and 30 to 32, and components selected from one or more posts, one or more brackets, one or more fasteners, one or more washers, one or more connection members, one or more wall mount brackets, a plurality of base post supports and combinations thereof.

BRIEF DESCRIPTION OF DRAWINGS

The following description of typical aspects described herein will be better understood when read in conjunction with the appended drawings. For the purpose of illustrating the invention, there are shown in the drawings aspects which are presently typical. It should be understood, however, that the invention is not limited to the precise arrangements and instrumentalities of the aspects shown in the drawings. It is noted that like reference numerals refer to like elements across different embodiments as shown in the drawings and referred to in the description.

The description herein will be more fully understood in view of the following drawings.

DESCRIPTION

Figure 1A:
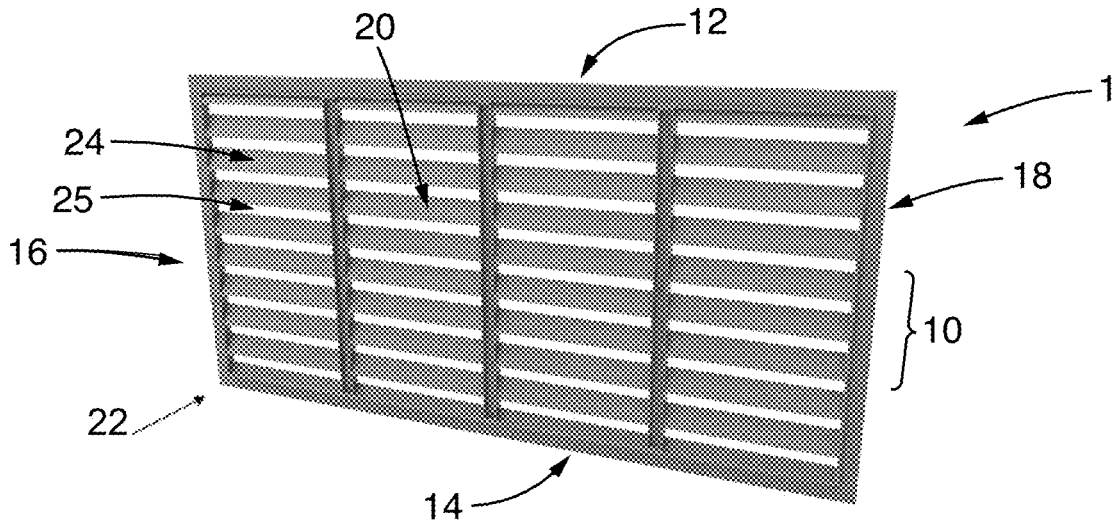
FIG. 1A is a front perspective view of a privacy panel showing a three dimensional decorative design in accordance with a non-limiting embodiment of the invention.
Figure 1B:
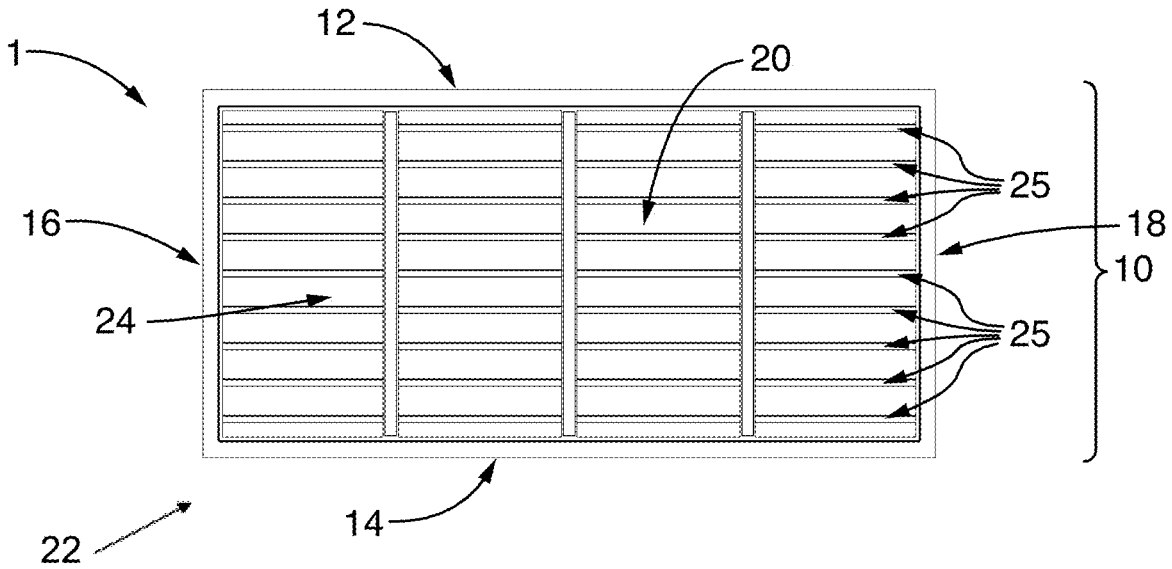
FIG. 1B is a front elevational view of the privacy panel of FIG. 1A.

All publications, patent applications, patents, and other references mentioned herein are incorporated by reference in their entirety. The publications and applications discussed herein are provided solely for their disclosure prior to the filing date of the present application. Nothing herein is to be construed as an admission that the present invention is not entitled to antedate such publication by virtue of prior invention. In addition, the materials, methods, and examples are illustrative only and are not intended to be limiting.

Unless defined otherwise, all technical terms used herein have the same meaning as commonly understood by one of ordinary skill in the art to which the invention pertains. Although any methods and materials similar or equivalent to those described herein can be used in the practice for testing of the present invention, the typical materials and methods are described herein.

It is also to be understood that the terminology used herein is for the purpose of describing particular aspects only, and is not intended to be limiting.

The articles "a" and "an" are used herein to refer to one or to more than one (i.e., to at least one) of the grammatical object of the article. By way of example, "an element" means one element or more than one element.

As used herein, the terms "invention" or "present invention" are non-limiting terms and not intended to refer to any single aspect of the particular invention but encompass all possible aspects as described in the specification and the claims.

As used herein the terms 'comprises', 'comprising', 'includes', 'including', 'having' and their inflections and conjugates denote 'including but not limited to' and are to be understood to be open-ended, e.g., to mean including but not limited to.

As used herein, the term "about" refers to variation in the numerical quantity. In one aspect, the term "about" means within 10% of the reported numerical value. In another aspect, the term "about" means within 5% of the reported numerical value. Yet, in another aspect, the term "about" means within 10, 9, 8, 7, 6, 5, 4, 3, 2, or 1% of the reported numerical value.

Should a range of values be recited, it is merely for convenience or brevity and includes all the possible subranges as well as individual numerical values within and about the boundary of that range. Any numeric value, unless otherwise specified, includes also practical close values and integral values do not exclude fractional values. Sub-range values and practically close values should be considered as specifically disclosed values.

It will be understood that any component defined herein as being included may be explicitly excluded from the claimed invention by way of proviso or negative limitation.

As may be used herein the terms 'close', 'approximate' and 'practically' denote a respective relation or measure or amount or quantity or degree that has no adverse consequence or effect relative to the referenced term or embodiment or operation or the scope of the invention.

As may be used herein any terms referring to geometrical relationships such as 'vertical', 'horizontal', 'parallel', 'opposite', 'straight', "lateral", "parallel", "perpendicular" and other angular relationships denote also approximate yet functional and/or practical, respective relationships.

As used herein "vertical" can be interchanged with "upright".

As used herein the term "panel" can be interchanged with "screen". Further, the panel/screen as described herein comprises a selected decorative three dimensional design that partially obstructs a sightline due to the presence of openings throughout the selected design.

As used herein, "insert molding" is a process to describe how the elongate metal bars are formed integrally (embedded) within desired locations in the molded privacy panel.

As used herein, "integrally formed" means "formed as a single piece". Refers to a part that is continuous in form and that any components making up the part have been rendered inseparable.

As used herein "embedded" means fixed firmly and deeply in a surrounding mass. With respect to the elongate reinforcement members in the privacy panel, these are embedded within the frame of the privacy panel in the top and bottom rails of the frame due to the insert molding/injection molding of the privacy panel.

As may be used herein, the terms 'preferred', 'preferably', 'typical', 'typically' or 'optionally' do not limit the scope of the invention or embodiments thereof.

As may be used herein the term 'substantially' (or synonyms thereof) denote with respect to the context a measure or extent or amount or degree that encompass a large part or most of a referenced entity, or an extent at least moderately or much greater or larger or more effective or more important relative to a referenced entity or with respect to the referenced subject matter.

As used herein the term 'may' denotes an option or an effect which is either or not included and/or used and/or implemented and/or occurs, yet the option constitutes at least a part of some embodiments of the invention or consequence thereof, without limiting the scope of the invention.

The phrase "and/or," as used herein in the specification and in the claims, should be understood to mean "either or both" of the elements so conjoined, e.g., elements that are conjunctively present in some cases and disjunctively present in other cases. Other elements may optionally be present other than the elements specifically identified by the "and/or" clause, whether related or unrelated to those elements specifically identified unless clearly indicated to the contrary.

As used herein in the specification and in the claims, "or" should be understood to have the same meaning as "and/or" as defined above. For example, when separating items in a list, "or" or "and/or" shall be interpreted as being inclusive, e.g., the inclusion of at least one, but also including more than one, of a number or list of elements, and, optionally, additional unlisted items. In general, the term "or" as used herein shall only be interpreted as indicating exclusive alternatives (e.g. "one or the other but not both") when preceded by terms of exclusivity, such as "either," "one of," "only one of," or "exactly one of."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

As used herein "a plurality" is understood to be any number greater than one. "Plurality" means "two or more".

As used herein "partition" is a non-load-bearing and free standing wall that is divided into parts, each part being a privacy panel of the invention. In one representative example, the partition comprises three parts, thus three privacy panels of the invention. Alternatively, one or two of the parts may be other materials such as wooden panels and the like. A partition can be interconnected at each end represented by a post to another partition of the same or different esthetic to form a partition system.

As used herein, "engineered" is understood to mean that the privacy panel is deliberately constructed for function rather than arising naturally and includes molding of the shape/construction.

As used herein, the "window" of the privacy screen is a framed area (enclosed by the frame) that comprises the 3D pattern and further admits some light and air. The 3D pattern provides esthetics but also visual impairment properties. As the engineered privacy screen of the invention is a one piece molded structure, the "window" is integrally formed with the frame.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

It should also be understood that, unless clearly indicated to the contrary, in any methods claimed herein that include more than one step or act, the order of the steps or acts of the method is not necessarily limited to the order in which the steps or acts of the method are recited.

Registration, Evaluation, Authorization and Restriction of Chemicals (REACH) is a European Union regulation dating from 18 Dec. 2006. REACH addresses the production and use of chemical substances, and their potential impacts on both human health and the environment. In accordance with the present invention, compliance with REACH provides that the methods described herein produce less than 1 ppm PAH during the processes and the products contain less than 1.0 ppm PAH.

The invention in embodiments and in aspects provides engineered privacy panels, a partition including one or more of the engineered privacy panels and a partition system that may include a plurality of interconnected partitions forming a variety of configurations and arrangements.

Surprisingly engineered privacy panels comprising recycled rubber materials can be injected molded to comprise any desired decorative three dimensional pattern. The injection molding of crumb rubber and granular polyolefin is demonstrated to be suitable to form a one piece panel structure that includes a reinforced frame supporting a window of a three dimensional decorative pattern. The one piece panel structure is molded to include elongate reinforcement members embedded within the polymeric crumb rubber matrix of the top and bottom of the frame and as such provide strength and rigidity to the panel structure. The reinforcement members also comprise the concealed fastening means, threaded inserts at each of their respective ends, each for receiving a fastening device for coupling each of the back corners of the panel to a support structure. In this manner, the front of the privacy panel is free of any fasteners and esthetically more pleasing.

The privacy panels of the invention are engineered to be easily reversibly fastened to vertical supports such as to fence posts and vertical walls without affecting the esthetic appeal of the panel. Fastening is reversible. Fastening of one panel does not affect the ability to fasten or unfasten a vertically adjacent panel. The back of the frame of the panel has fastening locations at each of the four corners of the frame where the elongated reinforcement members are embedded that comprise fastening means at each of their ends for receiving a fastening device to fasten the panel via a bracket to a vertical support. The position of the fastening means at each corner of the back of the frame provides a secure connection of the top and bottom of each side of the panel to a vertical support. Furthermore, as the connection means are concealed at the back corners of the panel they do not distract or affect the decorative esthetic appearance of the panel.

The privacy panels of the invention are unique in that their structure and design allows for the panel to be affixed to a vertical support using different types of brackets such that the panel can be fastened to a support in different spatial arrangements, such as by one side to a vertical post, at each side by vertical posts (panel perpendicular to bracket mounted on vertical post), or parallel and substantially parallel and flush against a wall (panel is positioned parallel with its vertical support member). The reinforcing members that provide strength and rigidity to the panel also comprise the concealed fastening means such that the panel can be securely fastened from the back of the panel without disturbing the esthetic appeal of the 3D pattern of the front of the panel and minimally noticeable on the back of the panel. Indeed, as wall mounted, the fastening means are not visible.

For purposes of description herein, the terms "top", "bottom", "right", "left", "side", "back", "front", "vertical", "horizontal" and derivatives thereof shall relate to the invention as oriented in FIGS. 1A-1F. However, it is to be understood the invention may assume various alternative orientations and step sequences, except where expressly specified to the contrary. It is also to be understood that the specific panels, partitions, partition systems and components illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

FIGS. 1A-1D show one design of an engineered privacy panel embodying the present invention with reference numeral 1 generally designating the privacy panel. The privacy panel 1 has a frame 10 that is continuous and has a top member 12, a bottom member 14, side member 16 and other side member 18. The frame 10 defines a window 20 that has a 3D pattern 24. The front of the panel 22 has a pattern 24 that is a conventional shutter pattern. Openings 25 are found in the 3D pattern that permit some air flow and light to pass through the 3D design.

Figure 1C:
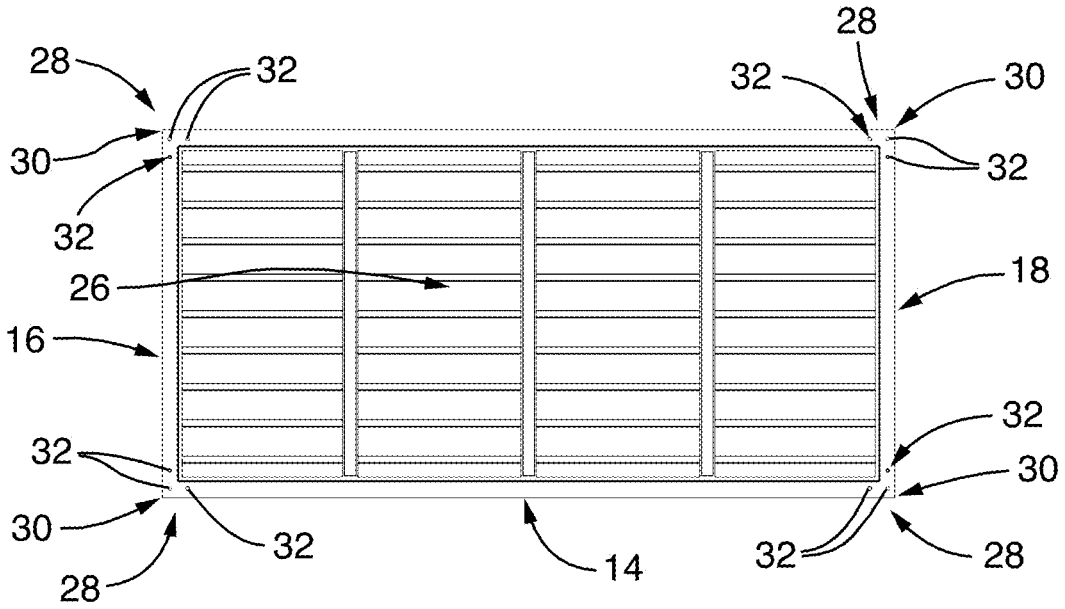
FIG. 1C is a back elevational view of the privacy panel of FIG. 1A/B.
Figure 1D:
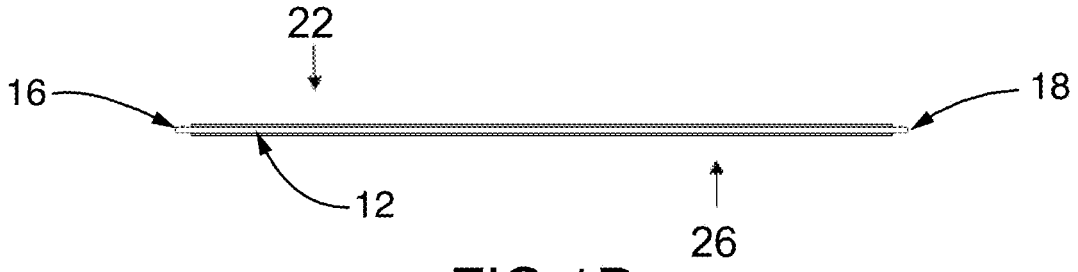
FIG. 1D is a top plan view of the privacy panel of FIG. 1A/B/C.

FIG. 1C shows the back 26 of the panel and that the 3D pattern of the panel is the same or very similar to the front 22 of the panel. Fastening points 28 are provided at each corner 30 of the panel. The fastening points 28 are the areas of the corners 30 of the panel where the threaded inserts are located. Threaded inserts 32 are positioned in the top member 12 at each top corner 30*a*. Threaded inserts 32 are positioned in the bottom member 14 of each bottom corner 30*b*. In addition the side member 16 also contains a top threaded insert 32 and a bottom threaded insert 32 and the other side member 18 contains a top threaded insert 32 and a bottom threaded insert 32.

Figure 1E:
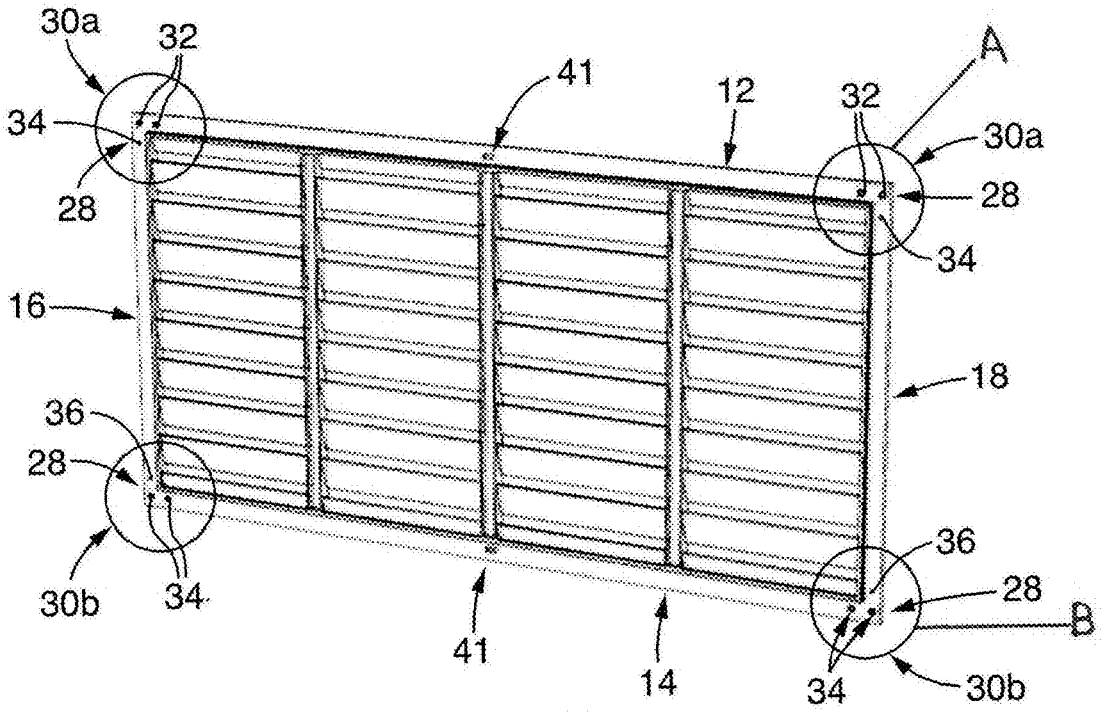
FIG. 1E is a further embodiment of the privacy panel of FIG. 1A that has centrally located connection member apertures on the top and bottom panel members.
Figure 1F:
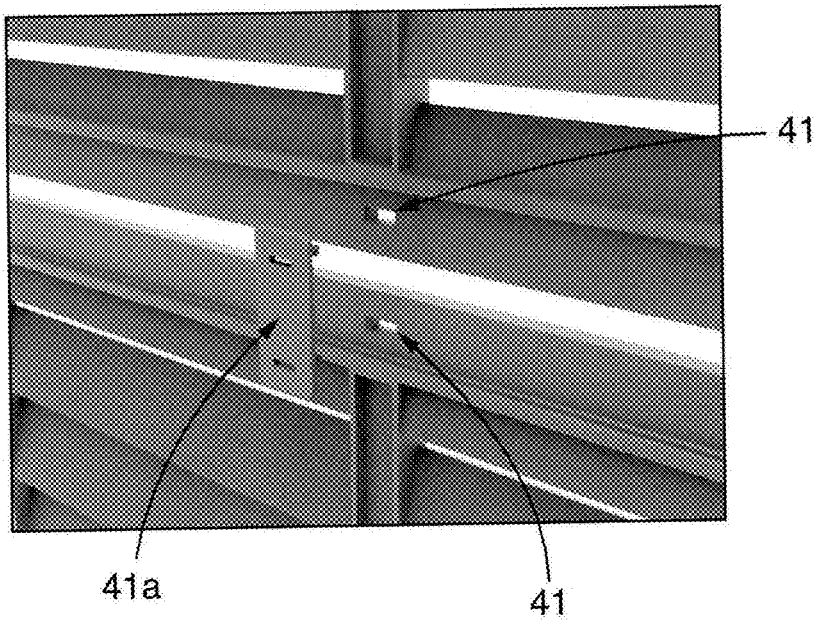
FIG. 1F is an enlarged partial view of two vertically adjacent panels of FIG. 1E showing an example of a connection member for engaging with the connection member apertures.

FIG. 1E shows a further embodiment of the panel 1 where a connection member aperture 41 is provided substantially central in the top member 12 and in the bottom member 14. A connection member aperture 41 can be formed within any panel design of the invention. As shown in FIG. 1F, an example of a connection member 41*a* functions to engage within apertures of two vertically adjacent panels to help to secure as desired.

Figure 2A:
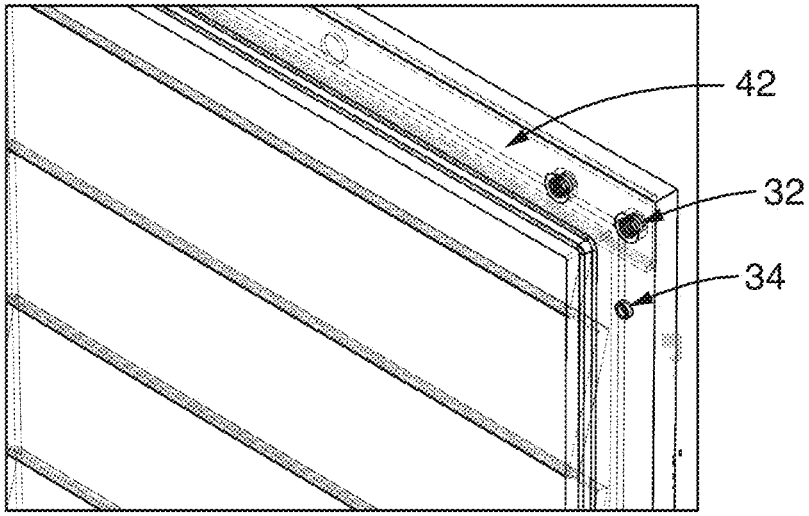
FIG. 2A is a partial perspective view of portion "A" of the privacy panel of FIG. 1E the privacy panel partially translucent show the two adjacent threaded holes that extend into the integral reinforcement member, shown in stippled lines, each for receiving a fastening device.
Figure 2B:
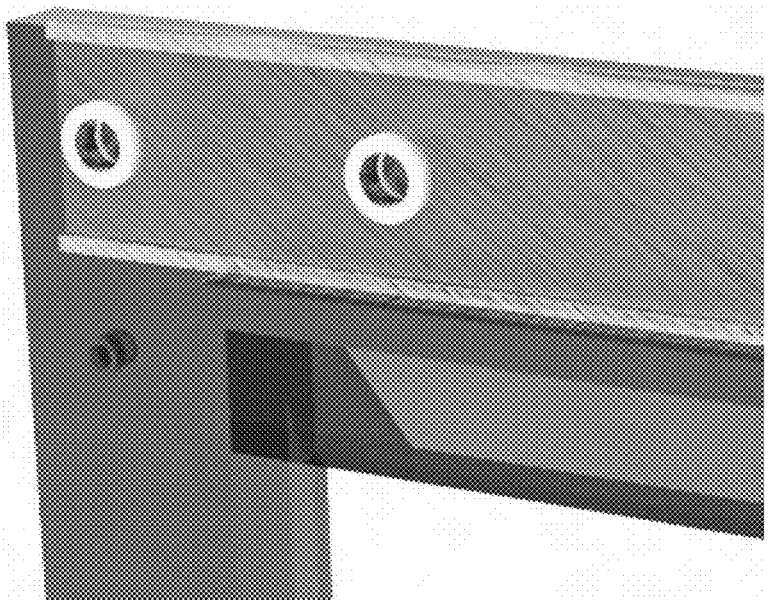
FIG. 2B is a partial perspective view of portion "B" of the privacy panel of FIG. 1E the privacy panel partially translucent to show the two adjacent threaded holes that extend into the integral reinforcement member, each for receiving a fastening device.
Figure 2C:
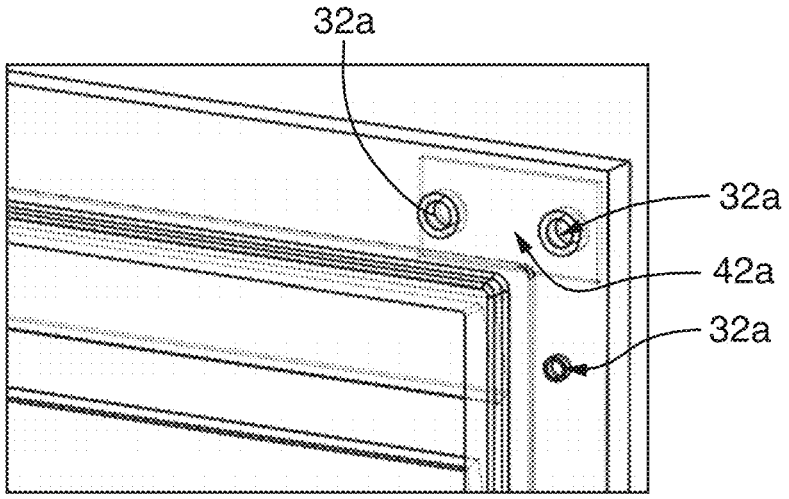
FIG. 2C shows the privacy panel partially translucent to show a further embodiment of the reinforcement member, the two adjacent threaded holes still extend into the shorter (e.g. smaller) integral reinforcement member, each for receiving a fastening device.
Figure 2D:
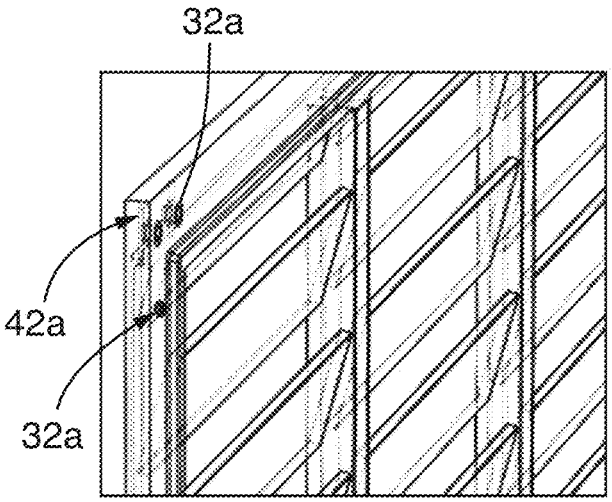
FIG. 2D shows a further view of the embodiment of FIG. 2C, whereby the body of the integral reinforcement member is shown in its entirety.
Figure 3A:
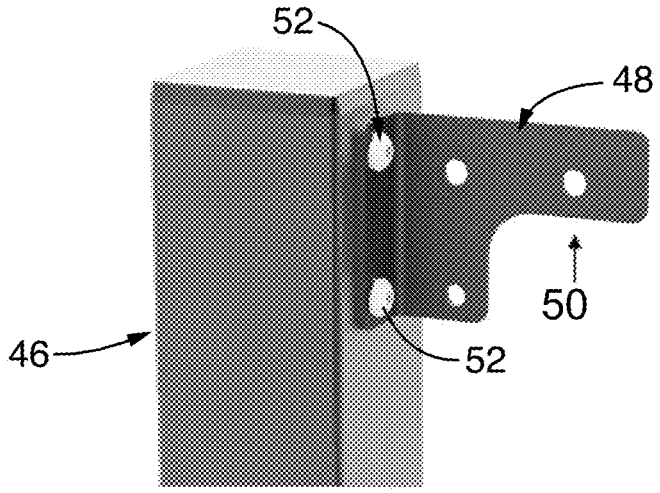
FIG. 3A shows an L type bracket mounted to a post with screws suitable for securing/fastening the privacy panel to the post.
Figure 3D:
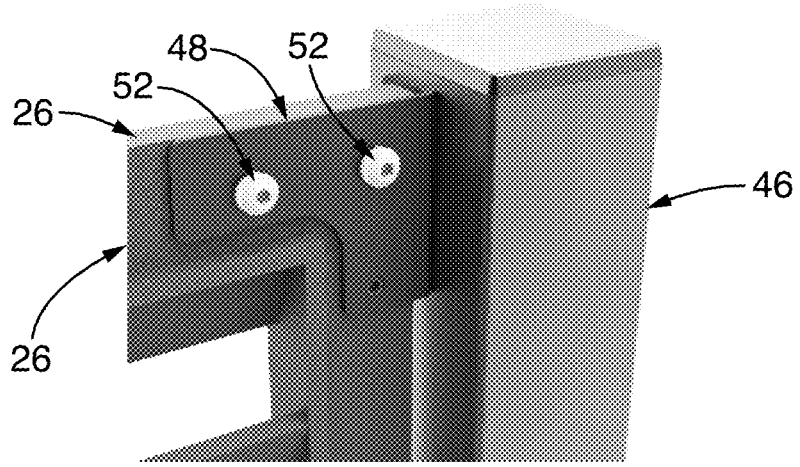
FIG. 3D shows a back corner of the frame fastened via the L type bracket to the post.
Figure 3E:
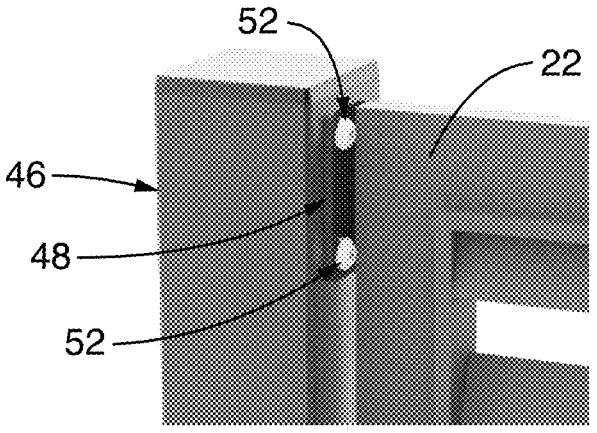
FIG. 3E shows a front corner of the frame of the panel as it is fastened to the post, illustrating that the fastening points are concealed at the back of the panel and are configured such that esthetic look of the front of the panel is not affected.
Figure 3B:
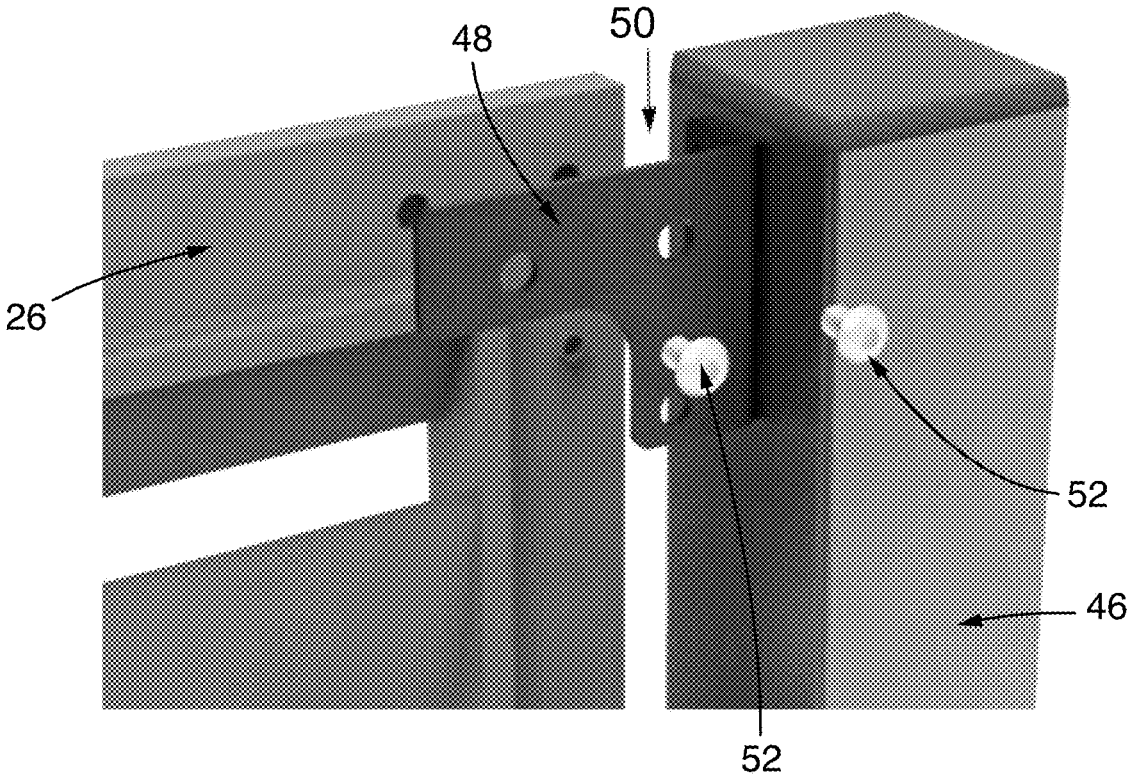
FIG. 3B shows a corner of the back of the frame of the privacy panel for lining up the adjacent threaded holes with the aperture of the L type bracket and the screws for fastening.
Figure 3C:
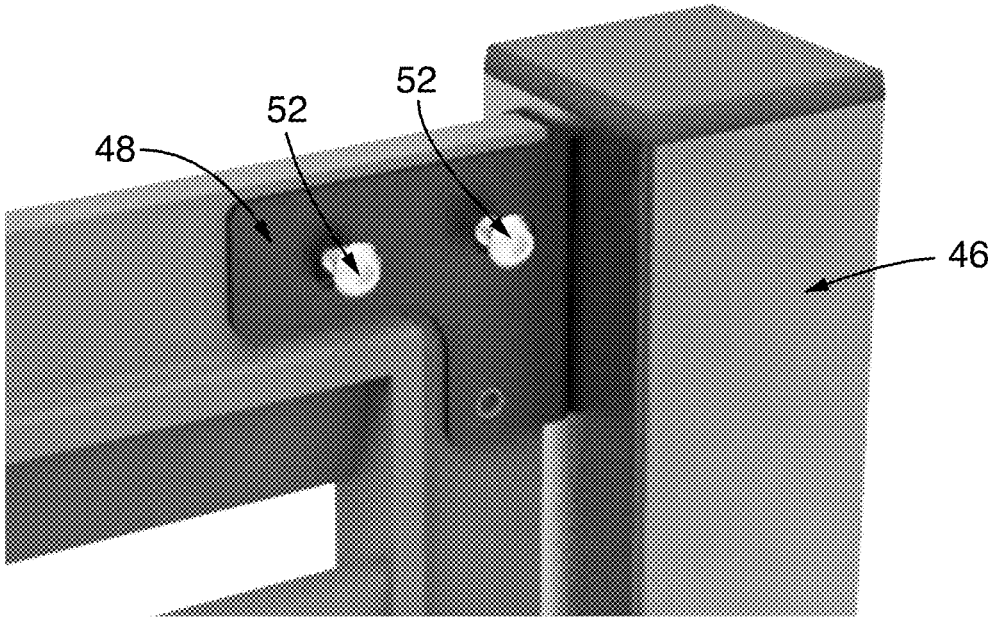
FIG. 3C shows the screws for fastening being driven through the back of the L type bracket to fasten the privacy panel to the bracket that is affixed/attached to the post.

As shown in FIGS. 2A and 2B, the elongate reinforcement member 42 is shown in phantom stippled to better illustrate the configuration of the threaded inserts 32 of the elongate reinforcement member 42. The configuration of the threaded inserts is the same in each corner 30 of the panel. FIGS. 2C and 2D show the discreet version of the reinforcement member 42*a* with threaded inserts 32*a*. It is within the scope of the invention to provide a combination of an elongate reinforcement member running along the entire length within the top and/or bottom member of the panel and also discreet elongate reinforcement members at each end corners. In this manner, an elongate reinforcement member can be integrally formed within for example the top member of the panel and two discrete reinforcement members 42*a* can be provided at each bottom corner, at each end of the bottom member—or vice versa. In further embodiments, the threaded inserts 32 and 34 can form the reinforcement member.

FIGS. 3A-3E show mounting of one corner 30 of the back of the panel 26 to a vertical post 46 using an L shaped bracket 48 with apertures 50 and screws 52. The L shaped bracket is shown fastened to the post using screws. The ease of fastening the panel to the post using the L shaped bracket is shown. The back of the panel 26 is mounted to the front of the L shaped bracket using two screws one into each threaded insert. As clearly shown in FIG. 3E, the fastening is discrete and does not draw attention away from the 3D pattern of the panel.

Figure 4:
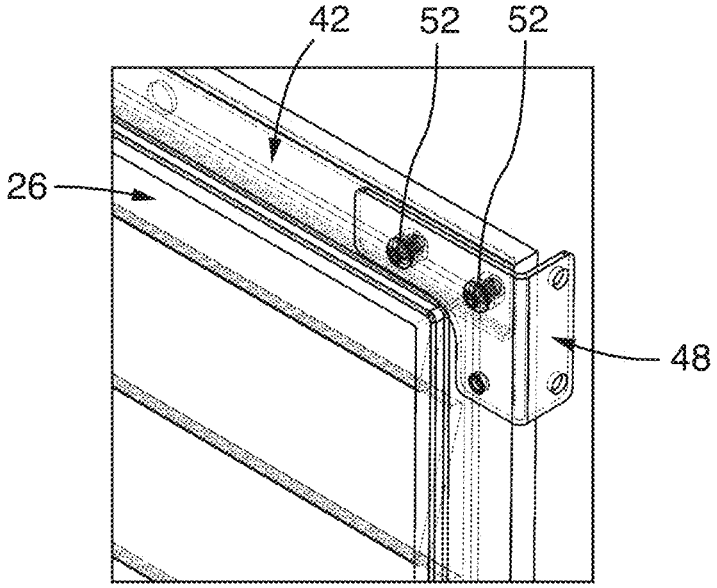
FIG. 4 is partially translucent to show that the screws are driven into the threaded holes and into the reinforcement member, shown in stippled lines.

FIG. 4 shows a bracket 48 fastened to the back of the panel 26 in phantom illustrating that the screws 52 engage with the elongated reinforcement member providing a very strong/secure connection. This fastening is similarly done at each corner 30 of the back of the panel 26.

Figure 5:
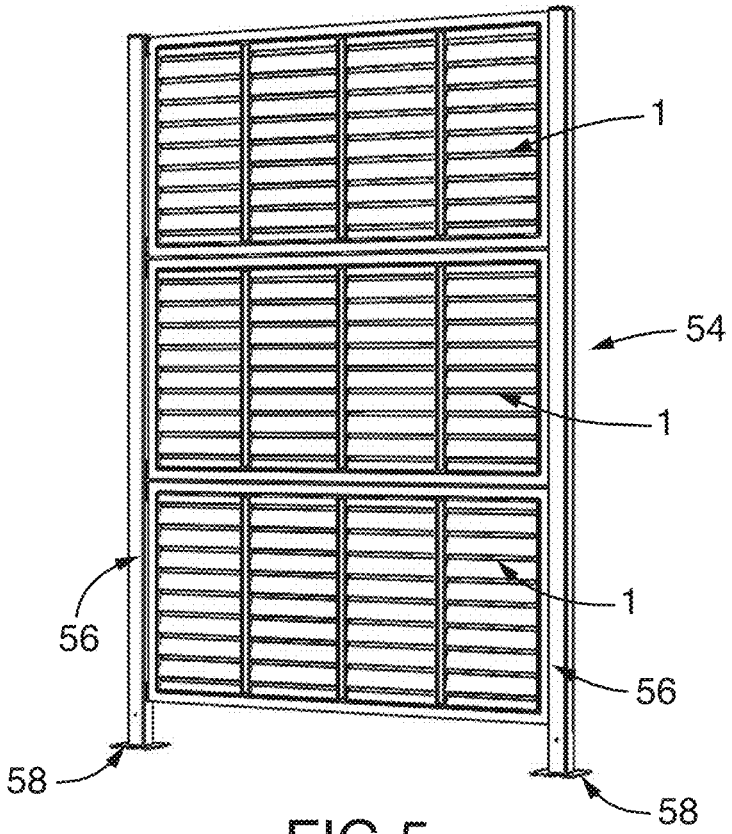
FIG. 5 is a partition made from three vertically positioned and fastened privacy panels shown in FIGS. 1A-1D, where each of the three privacy panels is fastened via brackets to the posts at each back corner of the frame of each privacy panel.

FIG. 5 shows a partition 54 formed with three privacy panels 1. The partition comprises two vertical posts 56 each with a base 58 that can be affixed to a ground material. The panels 1 are shown in a vertical orientation. Each panel is connected to each of the posts by each back corner as shown in FIGS. 3A-3E and FIG. 4 using four brackets per panel.

Figure 6A:
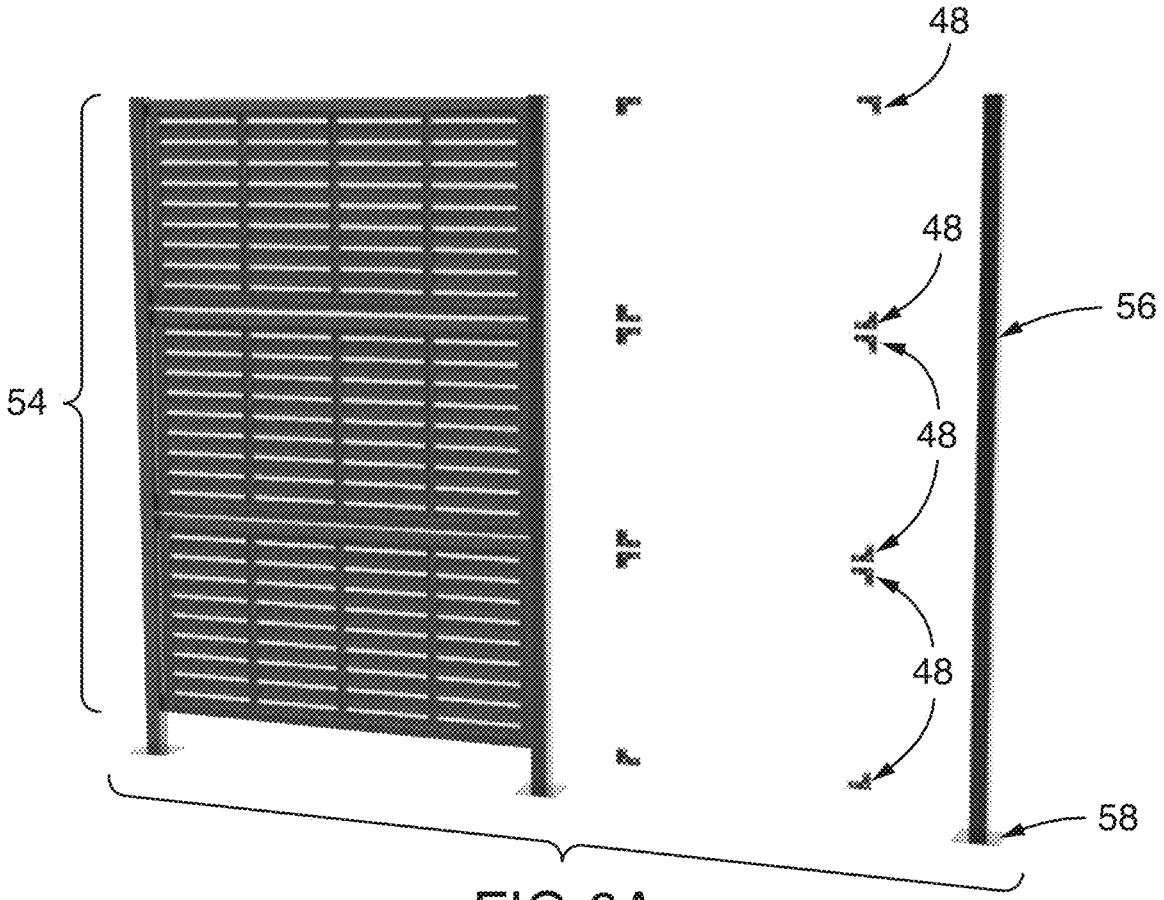
FIG. 6A shows an exploded view of the assembly of a system of partitions and positioning of the brackets with an additional post.
Figure 6B:
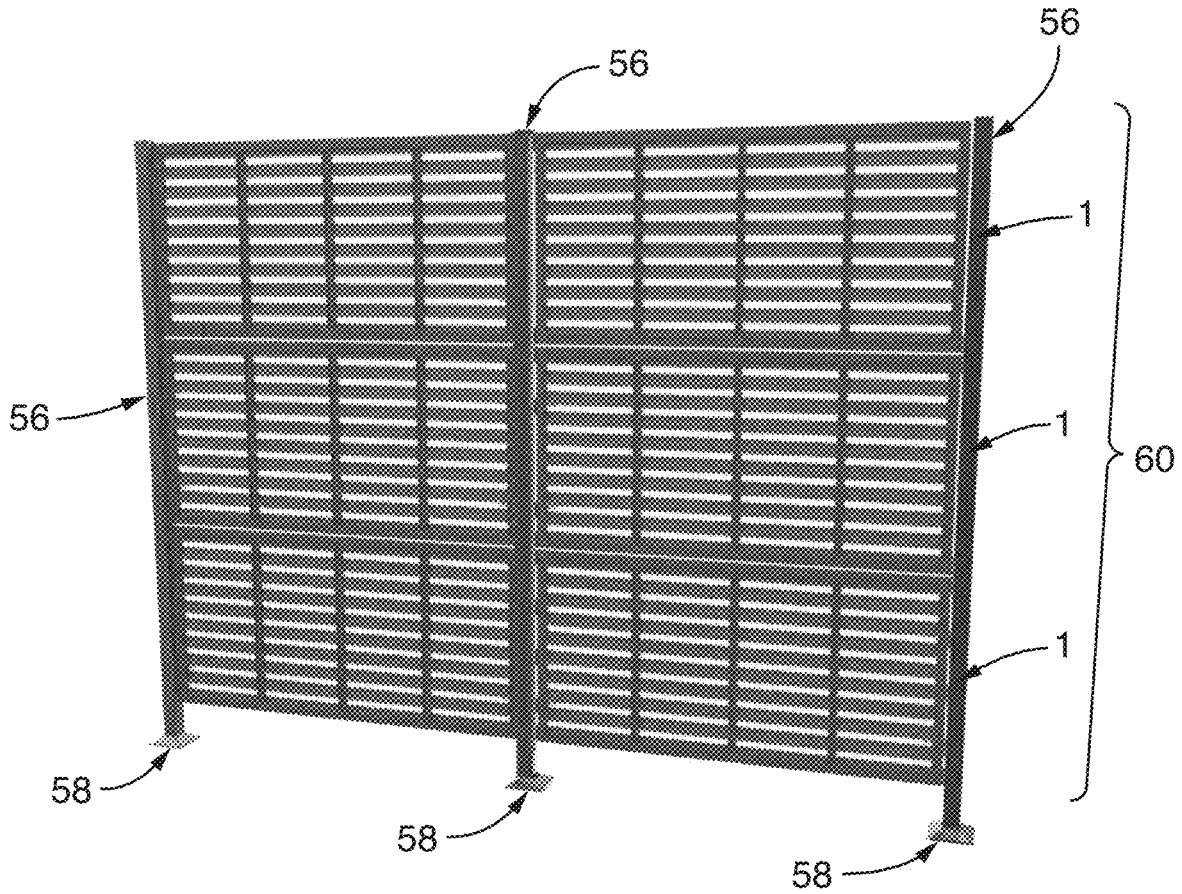
FIG. 6B shows an embodiment of a partition system using the privacy panel of FIG. 1A.

FIG. 6A shows a partition 54 and an intermediate of how a further partition can be added to form a partition system. FIG. 6B shows a completed partition system 60 in a side by side orientation.

Figure 7A:
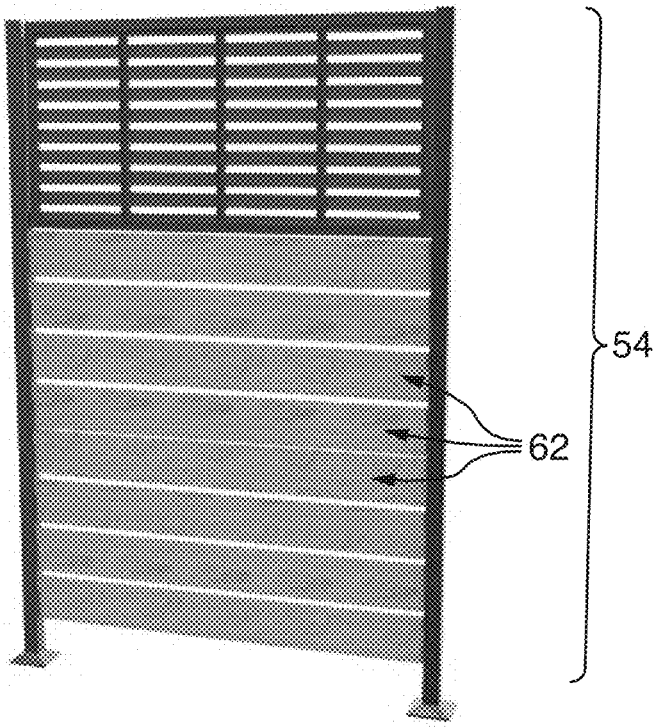
FIG. 7A shows a further embodiment of the invention where the privacy panels of the invention are to be combined with wooden panels to form a partition of a different design.
Figure 7B:
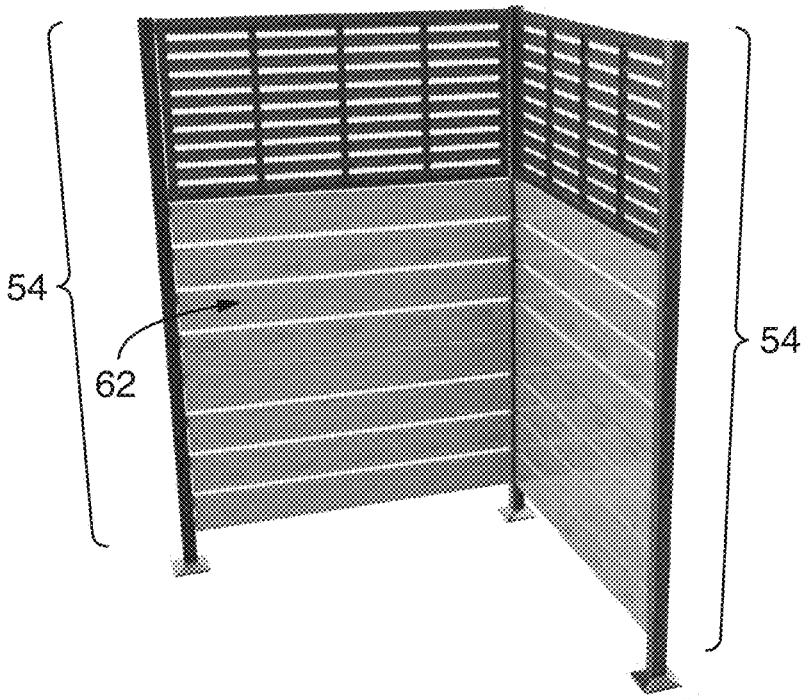
FIG. 7B shows a partition system combining two partitions shown in FIG. 7A and connected at a 90 degree angle forming an L-shaped configuration.
Figure 8A:
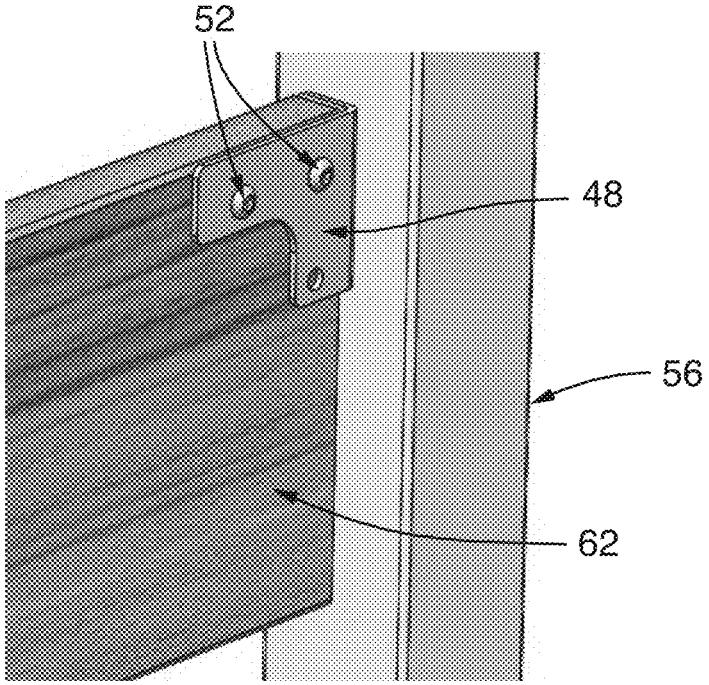
FIG. 8A is a back perspective view showing that the wooden panels are mounted to the post using the same L type bracket and in the same manner as the privacy panel.
Figure 8B:
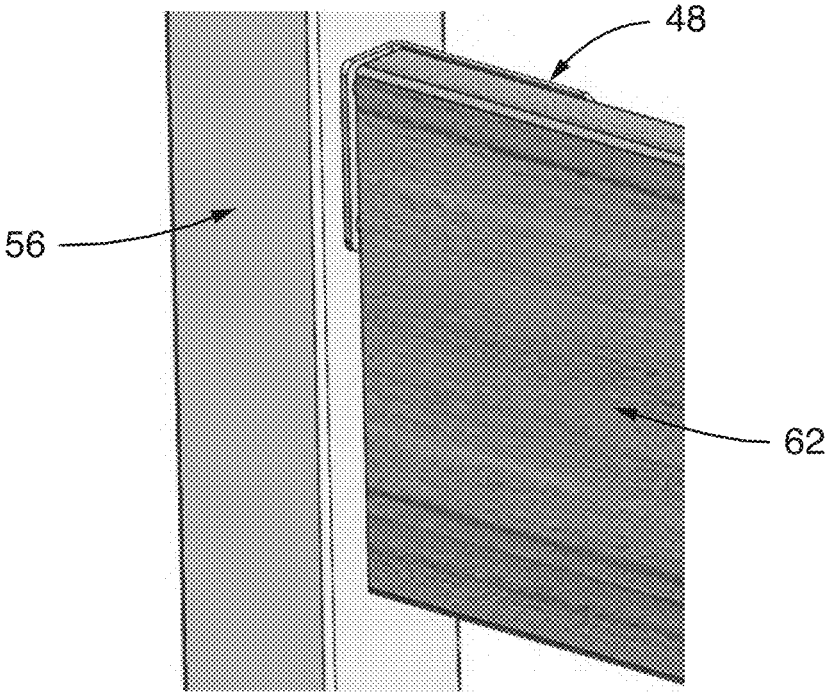
FIG. 8B is a front perspective view illustrating that the fastening points are concealed at the back of the wooden panel and are configured such that esthetic look of the front of the wooden panel is also not affected.

FIG. 7A shows a different configuration of a partition 54. In this configuration wooden planks 62 are used to form part of the partition for a different esthetic look. In FIG. 7B the two partitions of FIG. 7A are interconnected at a right angle. FIGS. 8A and 8B show that the same type of bracket 48 used for affixing the privacy panel is also used to fasten the wooden planks 62 to the post 56 such that the fastening remains done to fasten the back of the wooden planks to the front of the bracket keeping a visually clean consistent esthetic look.

Figure 9A:
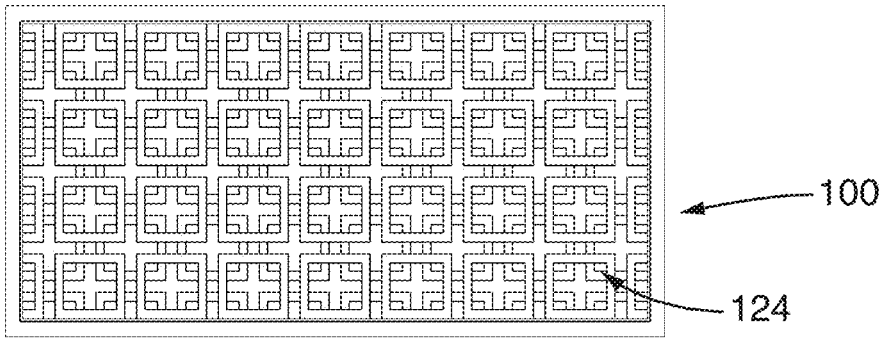
FIG. 9A shows a front perspective view of a privacy panel showing a different three dimensional decorative design in accordance with a further non-limiting embodiment of the invention.
Figure 9B:
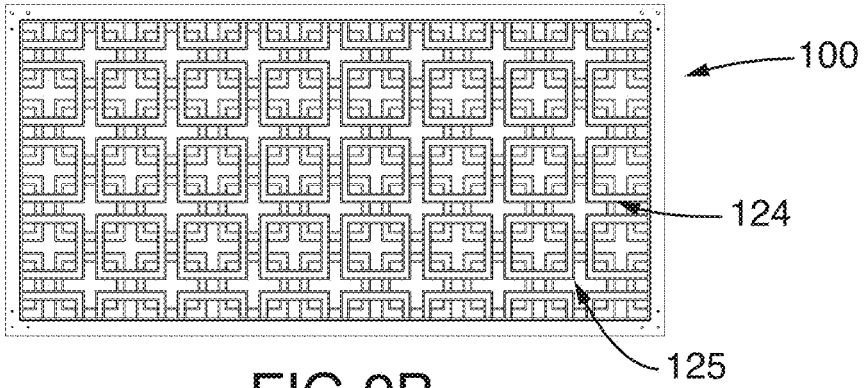
FIG. 9B shows a back perspective view of the privacy panel of FIG. 9A showing the fastening points at each corner of the panel.
Figure 9C:
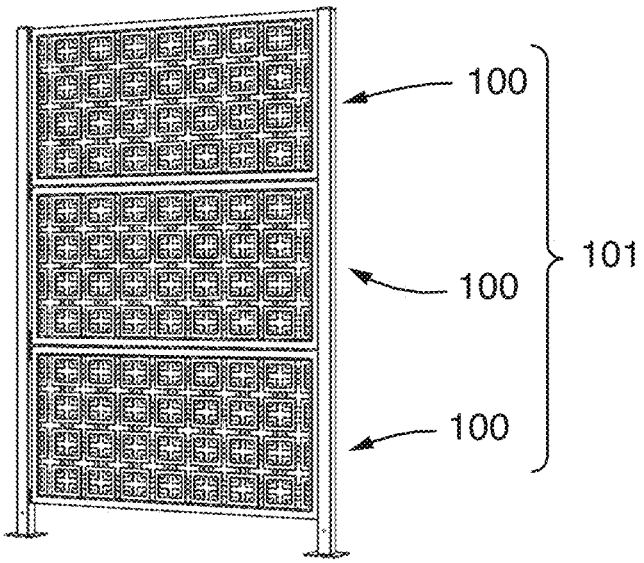
FIG. 9C is a partition made from three vertically positioned privacy panels shown in FIGS. 9A and 9B, where each of the three privacy panels is mounted via brackets to the posts at each corner.

FIGS. 9A-9C show another engineered privacy panel 100 within a partition 101 having a different 3D pattern 124 described as a knit design. As with the shutter design, the knit design also has openings 125 to allow for airflow and sunlight to pass through the knit design and yet maintain restricted visual permission through the panel.

Figure 10A:
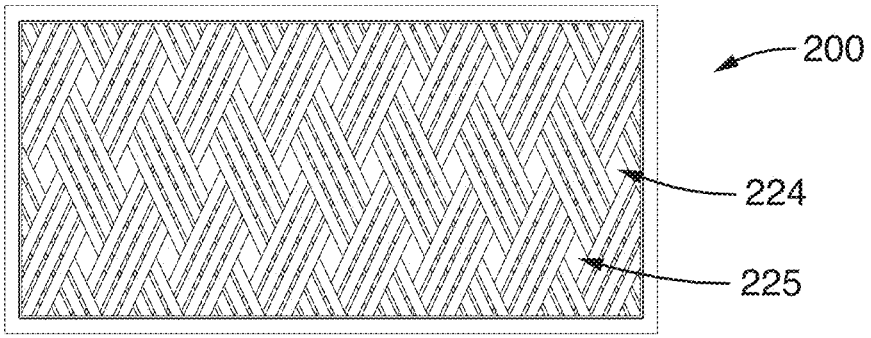
FIG. 10A shows a front perspective view of a privacy panel showing a different three dimensional decorative design in accordance with a further non-limiting embodiment of the invention.
Figure 10B:
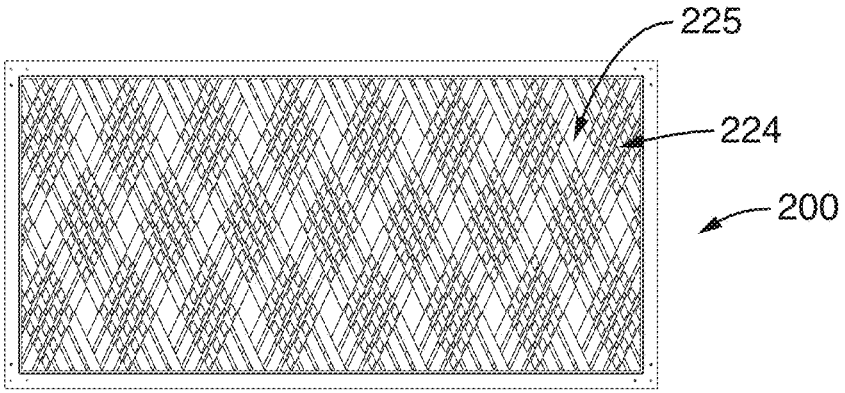
FIG. 10B shows a back perspective view of the privacy panel of FIG. 10A showing the fastening points at each corner of the panel.
Figure 10C:
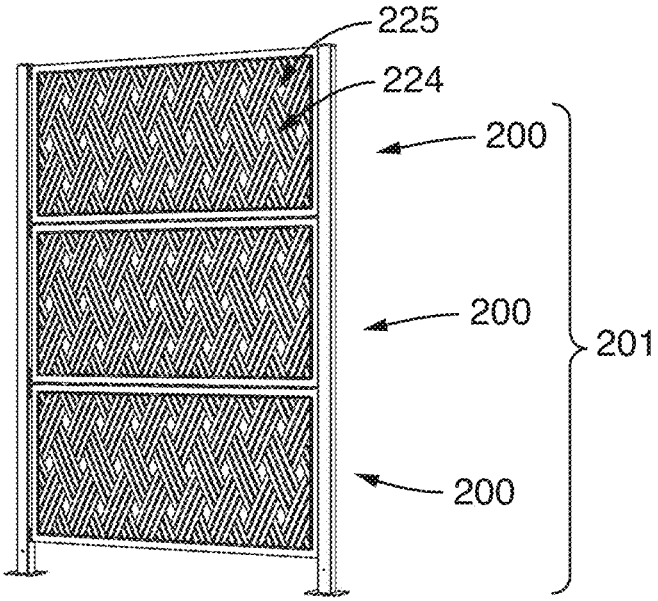
FIG. 10C is a partition made from three vertically positioned privacy panels shown in FIGS. 10A and 10B, where each of the three privacy panels is mounted via brackets at each back corner of each panel to the posts.
Figure 11A:
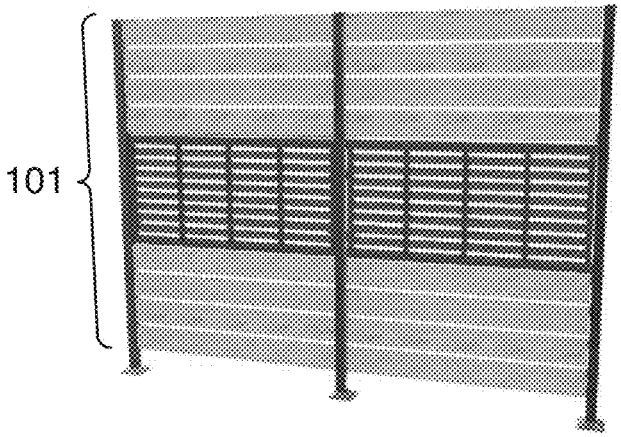
FIGS. 11A to 11F show further non-limiting partition system constructions comprising two partitions each incorporating the privacy panel of the invention having different three dimensional decorative designs and combined with wooden panels.
Figure 11B:
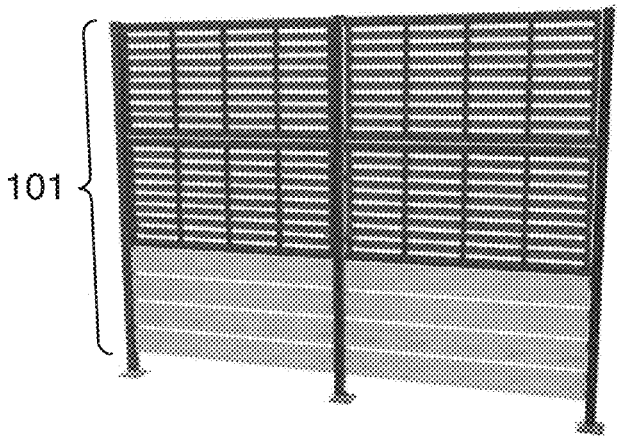
Figure 11C:
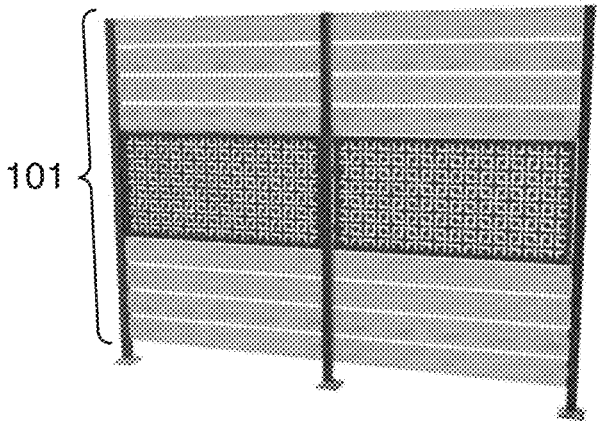
Figure 11D:
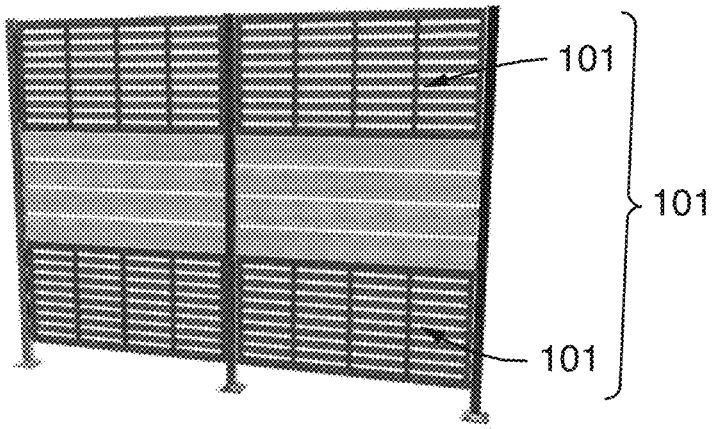
Figure 11E:
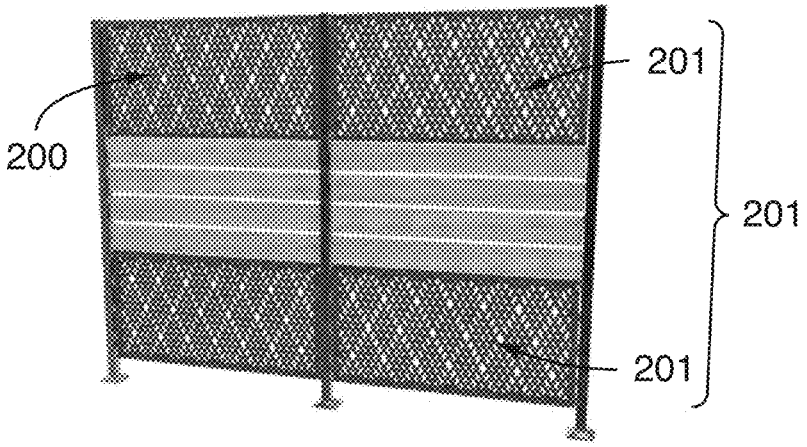
Figure 11F:
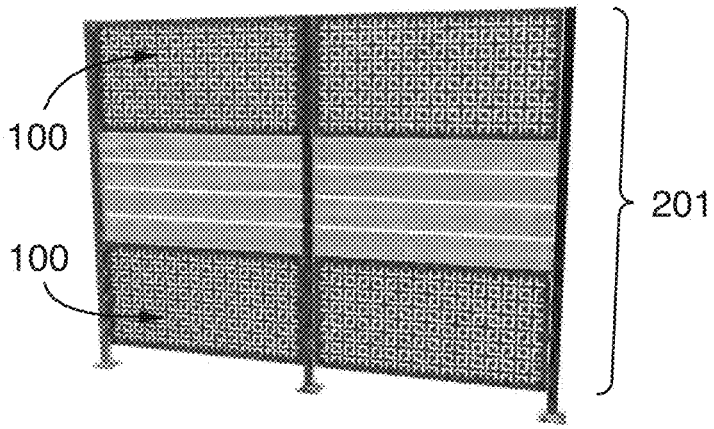

FIGS. 10A-10C show another engineered privacy panel 200 within a partition 201 having a different 3D pattern 224 described as a cross weave (x-weave) design. As with the shutter design and the knit design, the cross weave design also has openings 225 to allow for airflow and sunlight to pass through the knit design and yet maintain restricted visual permission through the panel.

FIGS. 11A-11F show a variety of different designs and arrangements of the privacy panel of the invention within a partition and within connected partitions forming a partition system. These are non-limiting as other designs and arrangements are within the scope of the invention. Any of the partitions shown can be connected by a 90 degree mount and one or more further partitions can be interconnected to any of the different designs to form enclosures or long partition systems.

Figure 12A:
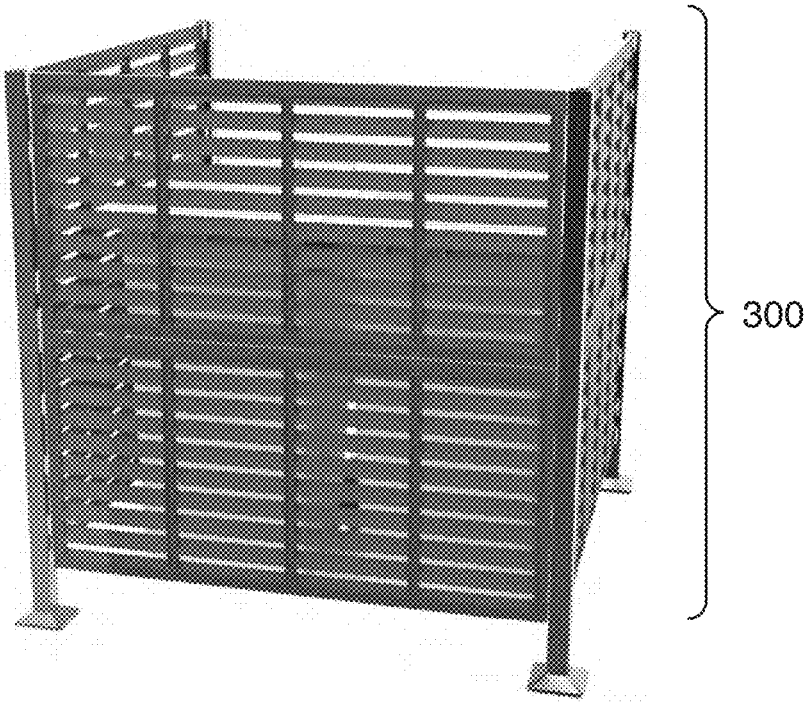
FIG. 12A shows a partition system made of three interconnected partitions, each of the partitions comprising privacy panels having a classic shutter three dimensional design. The partitions are connected at right angles to enclose and thus conceal outdoor bins in this example.
Figure 12B:
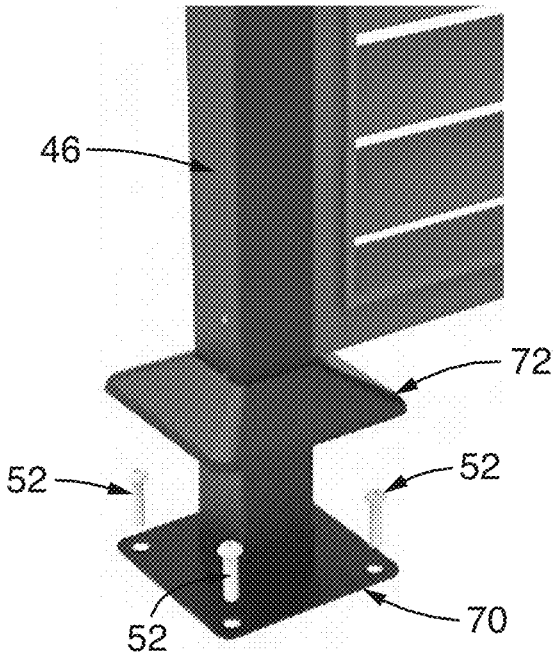
FIG. 12B shows how one representative and non-limiting base shown in the partition system of FIG. 12A is ground mounted.
Figure 12C:
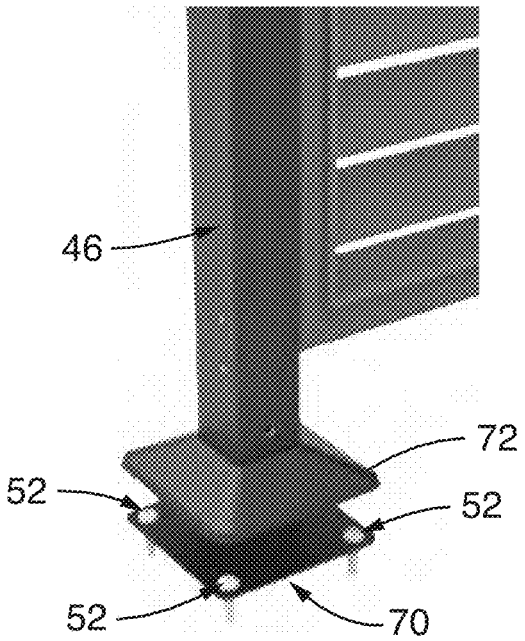
FIG. 12C shows that the base supporting the vertical post is screwed into the ground surface.
Figure 12D:
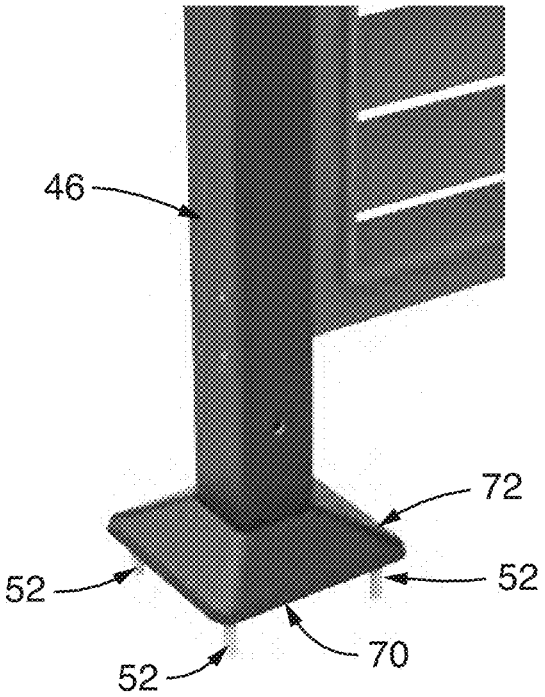
FIG. 12D shows the base cover over the plate to hide the screws.

FIG. 12A shows one enclosure configuration 300 using three partitions having a shutter design and connected at 90 degree angles. These types of configurations are suitable to use as enclosures. FIGS. 12B-12D show a representative type of base 70 and base cover 72 that can be used with a post 46. These can be affixed to any variety of ground surfaces such as grass, dirt, wood, concrete, tile, rubber. Further, these can be used with any material of post whether aluminum, wood, engineered wood, plastic, combinations thereof and the like. Thus the privacy panels of the invention can be mounted to any new or existing posts on any type of surface.

Figure 13A:
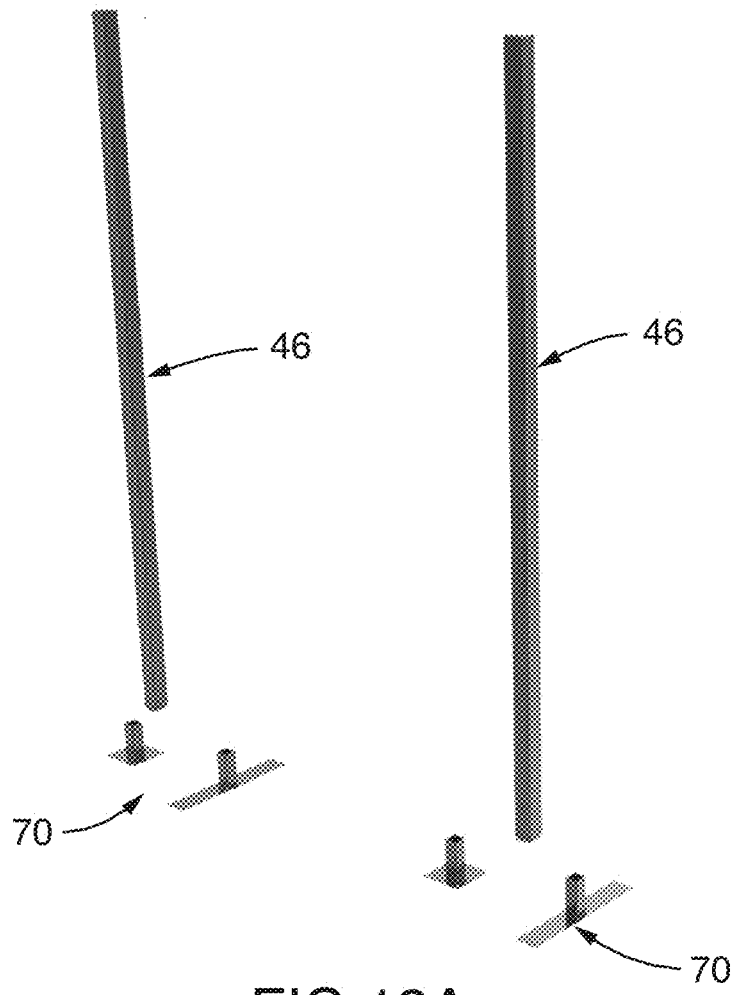
FIG. 13A shows components of a kit for a partition system of the invention, the components comprise L shaped mounting brackets, associated hardware (screws and lock washers), posts and bases.
Figure 13B:
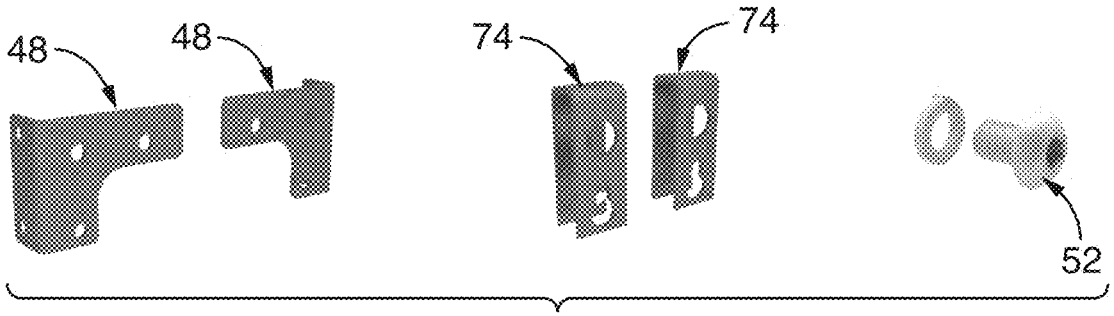
FIG. 13B shows a wall bracket for mounting of the privacy panel to a post, and a wall bracket for key hole mounting of the privacy panel against a vertical surface. The wall bracket may be sold as a kit with associated hardware (screws and lock washers) and panel.
Figure 13C:
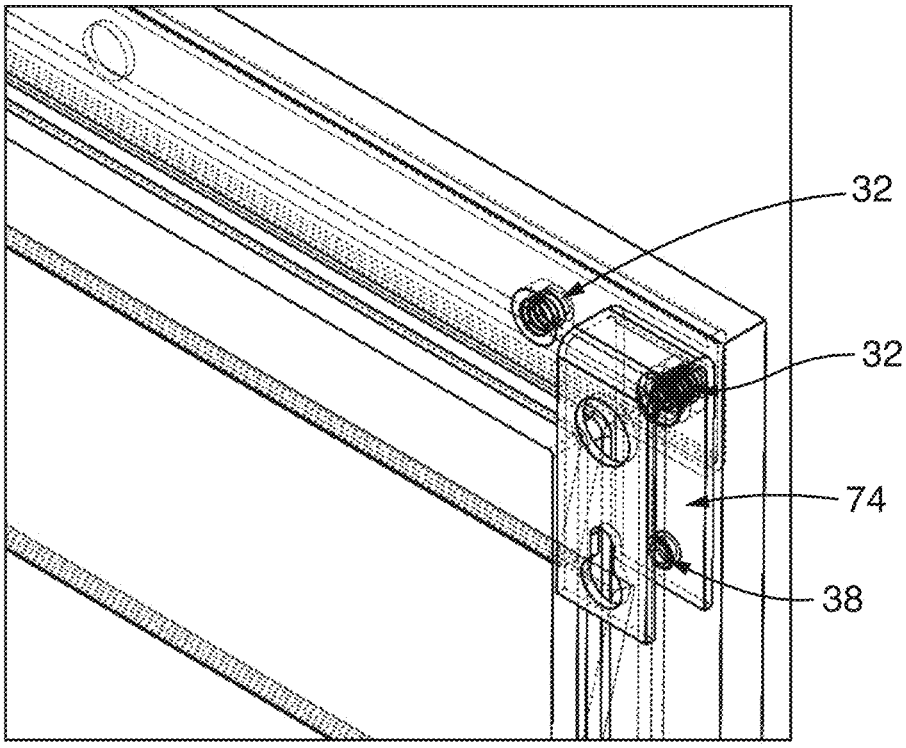
FIG. 13C shows a translucent view of a back top corner of the frame of a privacy panel showing a wall bracket fastened by a screw into a pre-threaded hole that extends through the reinforcement member for key hole mounting to a vertical surface.

FIG. 13A shows non-limiting examples of components that can be sold as part of a kit including the privacy panels of the invention. Such components may include the posts, bases for the posts, brackets, connection members and hardware. As a kit exact numbers of brackets, hardware, posts and bases can be included for specific constructions. FIG. 13B shows a wall mount bracket 74 that can be used and further included in a kit for vertically hanging the panel against a wall or other vertical structure. FIG. 13C is provided in phantom to show a wall bracket fastened to one back corner of the panel showing the screw inside the threaded insert providing a tight and strong connection. This would be repeated on the other top corner 30A of the back of the panel.

Figure 14:
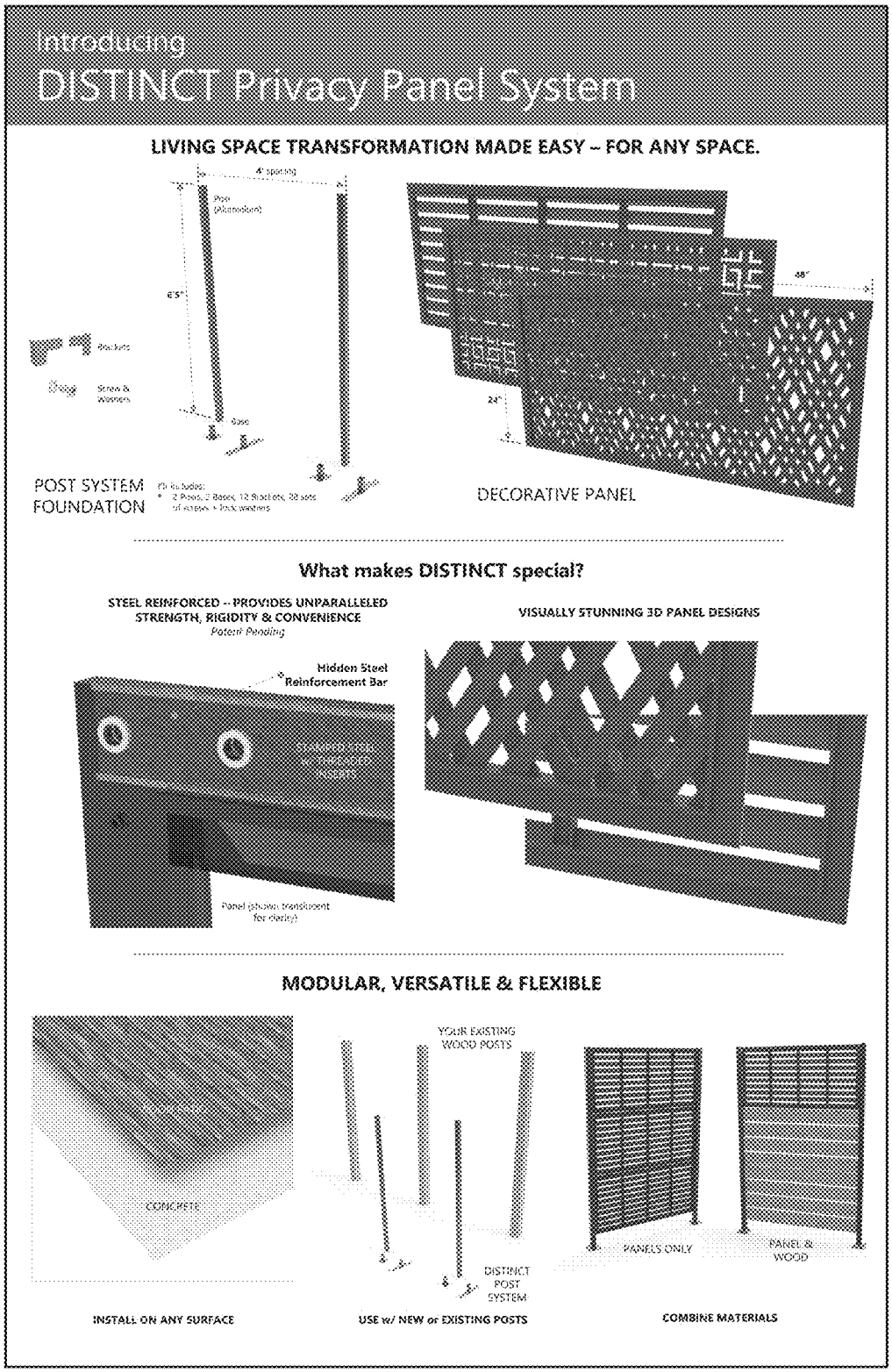
FIG. 14 shows a representative brochure for use in conjunction with any of the embodiments of the invention including component parts, kits, assembly into partitions and partition systems.
Figure 14:
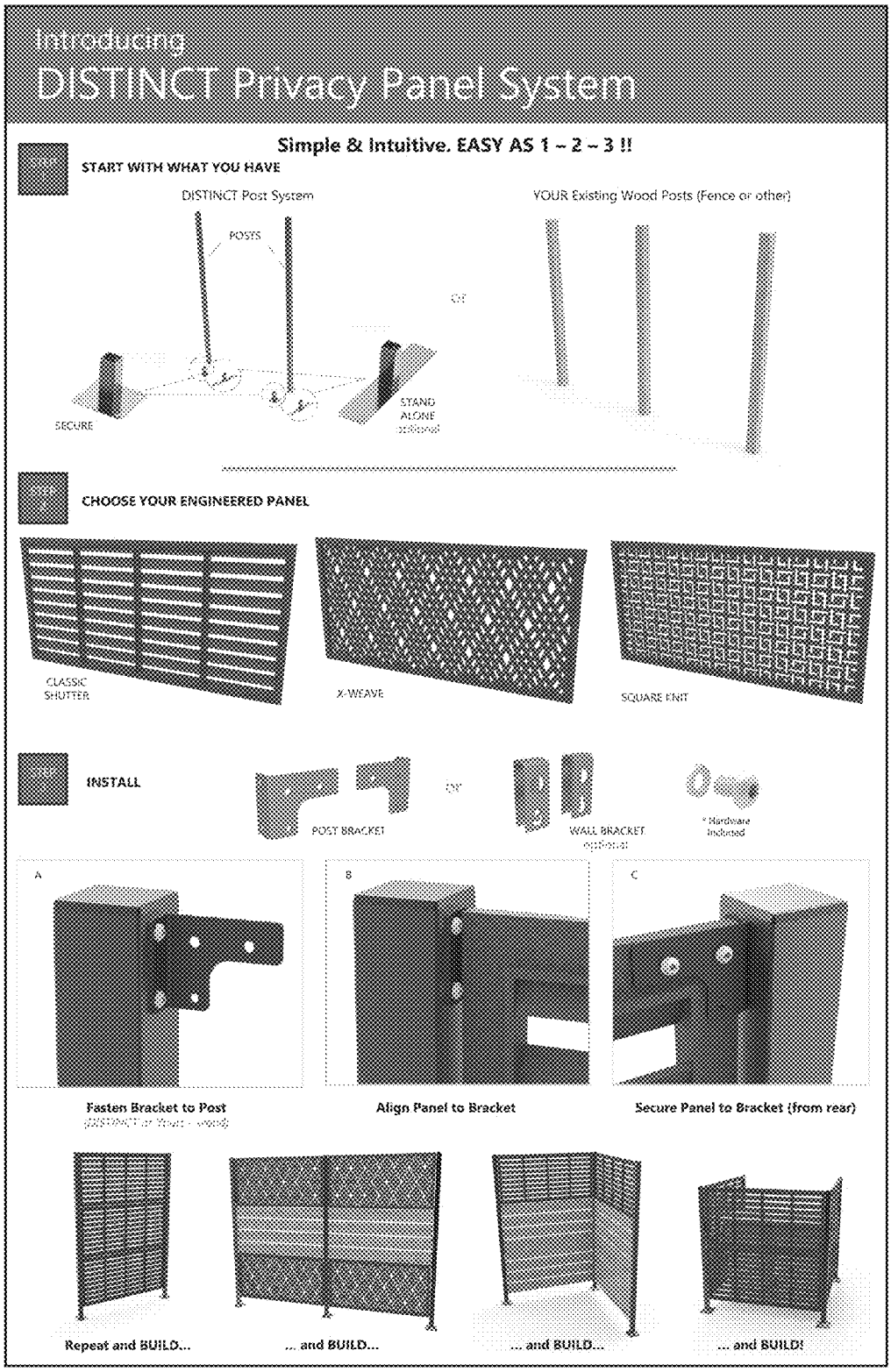
Figure 14:
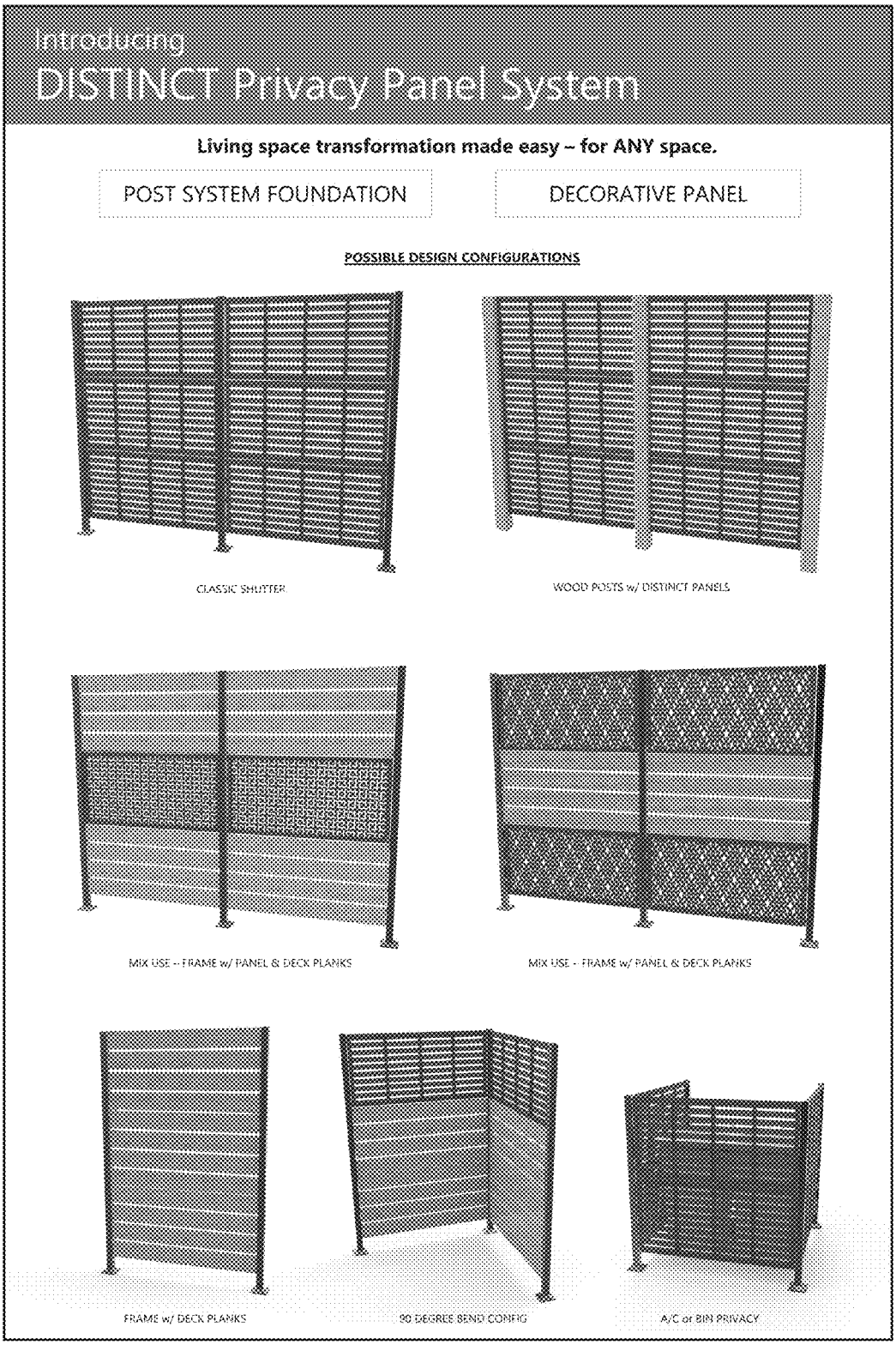
Figure 14:
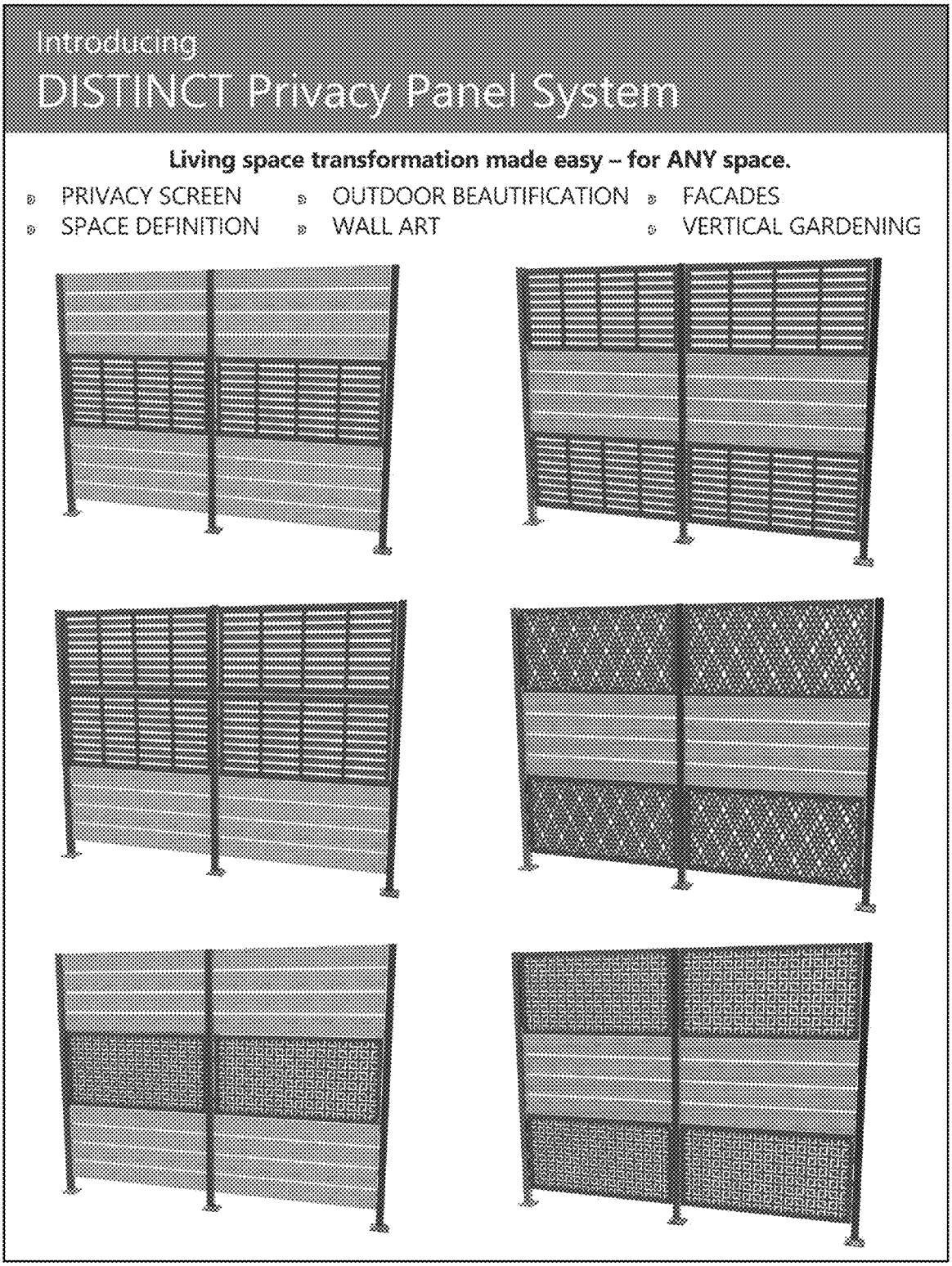

FIG. 14 is a representative and non-limiting brochure that can be sold as part of a kit comprising one or privacy panels of the invention. The brochure can also be used for sales promotion.

The privacy panels are made as a one piece molded body and therefore the elongate reinforcement members and/or discrete reinforcement members are embedded within frame locations into the recycled crumb rubber composition. As such they are insert molded in the injection molding of the panel.

One non-limiting sequence for making the panel is as follows:

1. The injection mold tool is installed with a chosen panel aesthetic design (a tooling insert). Each injection mold tool can yield multiple "3D patterns" of panels, but all panels have the same 'frame' design.
2. The injection mold machine is prepared with a mixture of crumb rubber and granular polyolefin in desired amounts with optional additives and colourants. The injection mold machine is prepared for heating (and cooling for the tool) for injection of the mixture.
3. The core/cavity of the injection mold tool is opened to expose the core and cavity.
4. Two steel reinforcement bars are placed into predetermined, static location(s) of the injection mold tool. Placement locations are to hold bars securely using any method such as magnets, clamps, friction fit pins, and the like or any other method prior to closing core and cavity side.
5. Once the two halves of the tool are closed, heated and now molten mixture is injected into the tool cavity ensuring it is filled.
6. One must ENSURE the threaded insert locations of the reinforcement bars are "sealed off" prior to their placement in the mold tool so that the molten mixture does not 'fill' the female machine thread of the insert.
7. Once the mold has had time to fill, cure and solidify, the tool is opened and the molded panel is safely ejected part from the injection molding machine.
8. Steps 3-7—constitute a single part cycle that is repeated.

As can be appreciated by one of skill in the art, the injection mold tool is sized to accommodate a desired size of panel. Representative non-limiting examples are a width of up to about 48 inches, a length (height) of up to about 24 inches and a thickness (at the thickest point) of up to about 1.5 inches, or up to about 1 inch.

Based on a panel of 48"×24" inches in size, weight of the panel may vary from about 5-9 lbs (not including weight of the steel bar reinforcing members). The weight may further vary, e.g. be decreased by incorporating the discreet sized reinforcement members that may for example be up to about 50 mm, up to about 100 mm in length, up to about 150 mm, up to about 200 mm, up to about 250 mm or more. The discreet sized reinforcement members are sized to accommodate the threaded inserts. The weight may be still further decreased should the panel be injected molded with sealed off threaded inserts as the reinforcement members or a combination of an elongate reinforcement member, discreet sized reinforcement member and threaded insert(s).

More specifically with respect to the mixture of crumb rubber and granular polyolefin for the injection molding, this is a dry composition comprising, or in aspects consisting of or consisting essentially of, crumb rubber and granular polyolefin where this dry ground composition is made such that the crumb rubber is relatively evenly dispersed with the granular polyolefin. This composition is fed into a barrel containing a feed extrusion screw. The polymer resin is heated to temperatures of between 140° C. to about 230° C. to a molten state by the combination of heating elements and shear heating from the extrusion screw. The polyolefin as it melts forms a matrix about the crumb rubber which remains intact. This mixture is worked by the screw such that it has the crumb rubber substantially evenly dispersed throughout the molten polyolefin and this mixture is conveyed by the screw, or screws as the case with twin screw extrusion, and injection molded into the cavity of the tool.

The resultant panel has substantially homogeneously dispersed crumb rubber with the matrix of the polyolefin throughout the formed panel. This substantially evenly dispersed mixture leads to more desirable properties of the panel and also a desired even esthetic look. As will be appreciated by one of skill in the art, the 3D pattern of the panel can have a complex design, however, the injection molding method used provides increased consistency in composition of matter throughout the panel.

In aspects, the compositions of the invention can comprise particles of crumb rubber comprising EPDM that is admixed with particulate polyolefin to form a mixture for molding, in one aspect injection molding. In aspects, each particle of crumb rubber can comprise SBR mixtures that may comprise EPDM.

The crumb rubber may be obtained from any variety of sources or suppliers and is often derived from old used tires or recycled rubber. In aspects rubber can be a synthetic rubber selected from styrene-butadiene rubber (SBR—a copolymer of styrene and butadiene), ethylene propylene diene rubber (EPDM—a terpolymer of ethylene, propylene and a diene-component), ethylene propylene rubber (EPR), butadiene rubber (BR) and mixtures thereof. Any rubber source can be of a recycled nature. In aspects the crumb rubber is granulated scrap/waste rubber from used tires (SBR). In further preferred aspects, the crumb rubber may comprise or consist of EPDM which has favorable properties in that it is a high density synthetic rubber that is extremely versatile and has desirable resistant properties against weathering, acids and alkali's. Some of EPDM's properties include: strong acid and alkali resistance; high temperature resistance up to 215° C.; flame retardant; excellent weathering properties; and a tensile range of 500-2500 P.S.I. EPDM is generally regarded as more environmentally friendly compared with crumb tire SBR rubber which contains higher zinc and polycyclic aromatic hydrocarbons (PAH) due to vulcanization and thus higher level of PAH are released due to the high aromatic oils used to mix the total recipe of the tire rubber. Oils and fats of the skin can absorb PAH's and therefore lower PAH release levels are desired with the use of EPDM. With the use of EPDM in the present invention PAH emissions are less than about 1.0 ppm or less than about 0.5 ppm (or up to but less than 1.0 ppm PAH) using methodology for measuring/quantitating PAH emission as is understood by one of skill in the art. In aspects, the crumb rubber may be any mixture of SBR and EPDM in ratios that provide less than 1.0 ppm PAH in a final product.

The crumb rubber for use in the invention can be of a variety of mesh sizes, for example up to about 10, 11, 12, 13, 14, 15, 16, 17, 18, 19, 20, 21, 22, 23, 24, 25, 26, 27, 28, 29, 30, 35, 40, 45, 50, 55, 60, 65, 70, 75 and 80 mesh including combinations thereof. In aspects, the crumb rubber is up to about 10 mesh or up to about 20 mesh including combinations of mesh sizes up to about 20 mesh. Such crumb rubber has particle sizes of about 0.15 to about 1.70 mm (Aldrich 2003-2004 Catalog/Handbook of Fine Chemicals).

The polyolefin for use in the composition to make the panels of the present invention is any polyolefin having a melt index ranging between about 5 g/10 minutes to about 50 g/10 minutes is suitable for use in the present invention. Representative examples are selected from the group consisting of polyethylene, polypropylene, polybutene, polyisoprene, polypentene and mixtures thereof. In aspects the polyolefin is polyethylene or polypropylene. In other aspects functionalized olefin polymers are not incorporated into the methods, compositions or panels of the invention. The polyolefin for use in the first dry grind composition is particulate and can be of any desired size up to about 80 mesh.

When heated at temperatures of about 140° C. to about 230° C., inclusive of any specific temperature in between, the polyolefin will melt about the crumb rubber. Any temperature within this range is suitable for use in the method. In aspects the temperature is about 180° C., about 181° C., about 182° C., about 183° C., about 184° C., about 185° C., about 186° C., about 187° C., about 188° C., about 189° C., about 190° C., about 191° C., about 192° C., about 193° C., about 194° C., about 195° C., about 200° C., about 205° C., about 210° C., about 215° C. and about 220° C.

The amount of crumb rubber to polyolefin used in the composition in the method to make the panels can range from about 20%:80% by weight to 80%:20% by weight. In aspects about 25% by weight of crumb rubber is used in the compositions. In further aspects, up to about 100% of the crumb rubber can be EPDM. In further aspects from about 25% to about 75% by weight EPDM. In further aspects about 5% by weight to about 60% by weight of the total amount of crumb rubber when mixed with other crumb rubber such as for example SBR.

The amount of polyolefin used to make the compositions of the invention, in the final shaped panel is about 15% to about 75% by weight, in aspects 15% to about 50% by weight, in aspects about 15% to about 40% by weight and in still further aspects at least about 50% by weight. One of skill in the art would understand that this would include amounts of about 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 58, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79 and 80% by weight.

The amount and type of crumb rubber and polyolefin selected for use may for example be a mix of about 50:50% by weight crumb rubber to polyolefin to achieve a desired shore harness A (where less than 70 is soft; 70 is standard and 90 is stiff) as would be understood by one of skill in the art. This is but one representative and non-limiting example. Other ratios such as 25:75% by weight crumb rubber to polyolefin is also desired to achieve a modified desired shore harness A.

Up to about 10% by weight additives can be incorporated as desired to improve certain properties of the end product, as would be understood by a skilled person. These are selected from the group consisting of titanium dioxide, UV stabilizers, calcium carbonate, talc, flame retardants and combinations thereof. The additives can be incorporated into the extruded sheet or within the composition of plurality of shaped particles. Thus the additives are incorporated into the final shaped product. It is also understood that in embodiments of the invention, no additives are incorporated.

Up to about 10% by weight colorant can be incorporated either into the sheet or within the composition of plurality of shaped particles. Thus into the final product. It is also understood that in embodiments of the invention, no colorants may be incorporated.

The engineered panels described herein have enhanced durability as being made of recycled crumb rubber composition, the panels are relatively unaffected by moisture and do not rot, rust or corrode. The panels of the invention are ecofriendly since they utilize recycled rubber (in aspects reclaimed from old tires) and can also incorporate reclaimed polyolefin. In addition, The recycled crumb rubber composition resists nicks and dents, does not peel, and when impacted, tends to return to its original shape.

Installation of the panels to vertical supports is simple and inexpensive, requiring only unskilled labor. No field cutting or special tooling is required nor any drilling. Fastening locations on supports are easy to determine.

Maintenance of the privacy panel is simple. In order to clean the privacy panel as described herein, one need only occasionally wash using a hose and optionally a light detergent. In addition, any damage such as damage by vandalism can be easily rectified by removing and replacing the damaged panels in the normal manner as described herein.

Advantageously, the privacy panels, partitions comprising one or more of the privacy panels disclosed herein and associated partition systems are easy to assemble, disassemble, ship, transport, and construct into a variety of suitable configurations and arrangements.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. It is, therefore, to be understood that the foregoing embodiments are presented by way of example only and that, within the scope of the appended claims and equivalents thereto, the invention may be practiced otherwise than as specifically described and claimed.

The descriptions of the various embodiments and/or examples of the present invention have been presented for purposes of illustration but are not intended to be exhaustive or limited to the embodiments and/or examples disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

We claim:

1. A panel comprising:

a body having a front face and a back face;

one or more embedded reinforcement members overcoated and located within the body and configured to provide support for the panel along a top member and a bottom member; and one or more fastening means accessible and visible only from the back face of the body, the one or more fastening means comprising one or more apertures formed in the one or more embedded reinforcement members and one or more threaded inserts, each threaded insert being received in a respective aperture of the one or more apertures and being configured to receive a fastener for securing the panel to a vertical support.

2. The panel of claim 1, comprising two, three or four embedded reinforcement members.

3. The panel of claim 1, wherein none of the one or more embedded reinforcement members extend a full length of the top member and bottom member of the body, the one or more embedded reinforcement members each having at least one of the one or more apertures formed at each of a first end and a second end of the one or more embedded reinforcement members.

4. The panel of claim 1, wherein one or more of the one or more embedded reinforcement members extend a full length of the top member and/or the bottom member of the body, the embedded reinforcement members having at least one of the one or more apertures formed at each of a first end and a second end of the one or more embedded reinforcement members.

5. The panel of claim 4, wherein each threaded insert received by the one or more apertures extend through the one or more embedded reinforcement members but do not penetrate the front face of the body.

6. The panel of claim 5, the body further comprising a frame, wherein the top member and the bottom member are connected by side members, wherein the side members have a first end and a second end and comprise a top threaded insert and a bottom threaded insert at each of the first end and the second end, respectively, for mounting a wall bracket.

7. The panel of claim 5, wherein the top member and/or the bottom member further comprise a substantially central connection member aperture formed within the one or more embedded reinforcement members.

8. The panel of claim 5, further comprising a fastener driven into each of the threaded inserts of the one or more embedded reinforcement members via the back face of the panel, wherein the fastener being driven through a bracket means to fasten the panel to the vertical support.

9. The panel of claim 4, wherein the panel is interconnectable with one or more other panels.

10. The panel of claim 1, wherein the one or more embedded reinforcement members are made of metal.

11. The panel of claim 10, wherein the metal is steel or a steel alloy.

12. The panel of claim 1, wherein the front face and the back face comprise a decorative pattern; optionally wherein the decorative pattern is three dimensional; optionally wherein the decorative pattern permits a flow of air and/or sunlight to pass through.

13. The panel of claim 12, wherein the decorative pattern comprises slats, a knot design or a cross-weave design.

14. The panel of claim 1, wherein the body comprises a recycled rubber composition.

15. The panel of claim 14, wherein the recycled rubber composition comprises one or more of: ground crumb SBR, EPDM, polyolefin, additives and colorants.

16. The panel of claim 15, wherein the recycled composition comprises the polyolefin, which is selected from the group consisting of polyethylene, polypropylene, polybutene, polyisoprene, polypentene and mixtures thereof.

17. The panel of claim 15, wherein the recycled rubber composition comprises ground crumb SBR and polyolefin, and wherein a ratio of ground crumb SBR to polyolefin is about 20:80 to 80:20 by weight.

18. A kit comprising:

the panel of claim 1; and one or more components selected from the group consisting of one or more posts, one or more brackets, one or more fasteners, one or more washers, one or more connection members, one or more wall mount brackets, and a plurality of base post supports.

* * * * *